US009839813B2

(12) United States Patent
Squires et al.

(10) Patent No.: US 9,839,813 B2
(45) Date of Patent: Dec. 12, 2017

(54) LOW DIMPLE COVERAGE AND LOW DRAG GOLF BALL

(71) Applicants: Arizona Board of Regents on behalf of Arizona State University, Scottsdale, AZ (US); George Washington University, Washington, DC (US)

(72) Inventors: Kyle Squires, Scottsdale, AZ (US); Nikolaos Beratlis, Washington, DC (US); Elias Baralas, Bethesda, MD (US)

(73) Assignees: ARIZONA BOARD OF REGENTS ON BEHALF OF ARIZONA STATE UNIVERITY, Scottsdale, AZ (US); GEORGE WARSHINGTON UNIVERSITY, Washington, DC (US)

( * ) Notice: Subject to any disclaimer, the term of this patent is extended or adjusted under 35 U.S.C. 154(b) by 0 days.

(21) Appl. No.: 15/197,548

(22) Filed: Jun. 29, 2016

(65) Prior Publication Data

US 2017/0001076 A1 Jan. 5, 2017

Related U.S. Application Data

(60) Provisional application No. 62/188,436, filed on Jul. 2, 2015.

(51) Int. Cl.
*A63B 37/14* (2006.01)
*A63B 37/00* (2006.01)

(52) U.S. Cl.
CPC ..... *A63B 37/0021* (2013.01); *A63B 37/002* (2013.01); *A63B 37/0004* (2013.01); *A63B 37/0005* (2013.01); *A63B 37/0006* (2013.01); *A63B 37/0016* (2013.01); *A63B 37/0018* (2013.01); *A63B 37/0019* (2013.01)

(58) Field of Classification Search
CPC ..... A63B 37/0021; A63B 37/0005; A63B 37/0004; A63B 37/0018; A63B 37/0006; A63B 37/0012; A63B 37/0015
See application file for complete search history.

(56) References Cited

U.S. PATENT DOCUMENTS 878,254 A * 2/1908 Taylor ..... A63B 37/0004 473/384
4,141,559 A * 2/1979 Melvin ..... A63B 37/0003 473/372

(Continued)

*Primary Examiner* — John E Simms, Jr.
(74) *Attorney, Agent, or Firm* — Quarles & Brady LLP

(57) ABSTRACT

A golf ball has a lower drag than conventional golf balls due to the arrangement of dimples on the outer surface of the golf ball, which arrangement produces a correspondingly lower percentage of outer surface area that is covered by the dimples. In particular, dimple coverage area may be less than 70%, and more specifically between about 18.6% and about 60.8%, of the outer surface area. Various combinations of dimple characteristics can be combined to produce the low dimple coverage, low drag golf ball, such as the number of dimples, pattern and spacing of dimples, dimple diameter, dimple depth, and dimple shape. The dimple characteristics can be selected so that the golf ball meets the requirements of the United States Golf Association and other golf organizations.

15 Claims, 23 Drawing Sheets

(56) References Cited

U.S. PATENT DOCUMENTS

| | | | | |
|---|---|---|---|---|
| 4,284,276 | A * | 8/1981 | Worst | A63B 37/0004 40/327 |
| 4,869,512 | A * | 9/1989 | Nomura | A63B 37/0004 473/383 |
| 5,158,300 | A * | 10/1992 | Aoyama | A63B 37/0004 40/327 |
| 6,224,499 | B1 | 5/2001 | Ogg | |
| 6,551,203 | B2 | 4/2003 | Ogg | |
| 6,626,772 | B1 * | 9/2003 | Kennedy, III | A63B 37/0004 473/384 |
| 6,702,696 | B1 * | 3/2004 | Nardacci | A63B 37/0004 473/378 |
| 6,749,525 | B2 | 6/2004 | Aoyama | |
| 6,849,007 | B2 | 2/2005 | Morgan et al. | |
| 6,969,327 | B2 | 11/2005 | Aoyama et al. | |
| 7,179,177 | B2 | 2/2007 | Kennedy, III | |
| 7,226,369 | B2 | 6/2007 | Aoyama et al. | |
| 7,390,272 | B2 | 6/2008 | Kasashima et al. | |
| 7,481,723 | B2 | 1/2009 | Sullivan et al. | |
| 7,503,856 | B2 | 3/2009 | Nardacci et al. | |
| 7,837,578 | B2 | 11/2010 | Aoyama | |
| 8,047,933 | B2 | 11/2011 | Stefan et al. | |
| 8,066,588 | B2 | 11/2011 | Sullivan et al. | |
| 8,083,613 | B2 | 12/2011 | Sato et al. | |
| 8,137,216 | B2 | 3/2012 | Sullivan et al. | |
| 8,292,758 | B2 | 10/2012 | Sullivan et al. | |
| 8,617,003 | B2 | 12/2013 | Sullivan et al. | |
| 8,663,032 | B2 | 3/2014 | Fitchett et al. | |
| 2001/0024983 | A1 | 9/2001 | Morgan et al. | |
| 2003/0045378 | A1 | 3/2003 | Bissonnette et al. | |
| 2003/0171167 | A1 * | 9/2003 | Kasashima | A63B 37/0004 473/378 |
| 2004/0152541 | A1 * | 8/2004 | Sajima | A63B 37/0004 473/378 |
| 2005/0187039 | A1 | 8/2005 | Kennedy, III | |
| 2006/0019772 | A1 | 1/2006 | Sullivan et al. | |
| 2006/0025243 | A1 | 2/2006 | Tapper et al. | |
| 2010/0173728 | A1 | 7/2010 | Aoyama | |
| 2011/0098135 | A1 * | 4/2011 | Ono | A63B 37/0004 473/383 |
| 2012/0165131 | A1 | 6/2012 | Nakamura | |
| 2016/0271455 | A1 * | 9/2016 | Hwang | A63B 37/0007 |

* cited by examiner

| Golf ball | No. of dimples | Dimple cov. | Dimple vol. | $C_d$ @ Re=190000 |
|---|---|---|---|---|
| 50 | 92 | 14.3% | 0.38% | 0.166 |
| 51 | 120 | 18.6% | 0.49% | 0.173 |
| 52 | 162 | 25.1% | 0.67% | 0.195 |
| 53 | 272 | 43.4% | 1.13% | 0.215 |
| 54 | 392 | 60.8% | 1.61% | 0.27 |
| 55 | 120 | 18.6% | 0.65% | 0.187 |
| 56 | 120 | 27.1% | 0.71% | 0.174 |
| 57 | 120 | 18.6% | 0.77% | 0.215 |

LOW DIMPLE COVERAGE AND LOW DRAG GOLF BALL

CROSS-REFERENCE TO RELATED APPLICATIONS

This patent application is a non-provisional and claims the priority of U.S. Prov. Pat. App. Ser. No. 62/188,436, having the same title, filed Jul. 2, 2015, and incorporated fully herein by reference.

FIELD

The present invention is generally related to the field of golf balls, and more specifically to a golf ball having low dimple coverage and low drag.

BACKGROUND

Golf has become an increasingly popular sport with both amateurs and professionals, which has spurred the development of a wide range of technologies related to the design and manufacture of golf balls to improve the flight performance of a golf ball. The flight performance of the golf ball is affected by a variety of factors including the weight, size, materials, dimple pattern, and external shape of the golf ball. The United States Golf Association ("USGA") sets the limits for the maximum weight of a golf ball to 45.93 grams (1.62 oz) and the minimum diameter of a golf ball to 42.67 grams (1.680 oz). Golf ball manufacturers seek to improve the performance of golf balls by adjusting the materials and construction of the ball within USGA constraints, and adjusting the dimple pattern and dimple shape to enhance the aerodynamics.

There are two important dimensionless parameters related to golf ball aerodynamics: the Reynolds number ($Re=UD/v$) and the dimensionless spinning rate ($\alpha=\omega*D/(2U)$). In these equations, U is the speed of the golf ball, D is the diameter of the golf ball, v is the kinematic viscosity of the air, and $\omega$ is the angular velocity of the golf ball. The Reynolds number Re measures the effect of inertial to viscous forces and is generally in the range of Re=80,000 to Re=250,000 during the flight of a golf ball. The spinning rate a is the ratio of the tangential rotational velocity of the golf ball to its translation speed and measures how fast the golf ball is spinning compared to its translational speed, and is generally between $\alpha=0.1$ to $\alpha=0.3$.

During the flight of a golf ball the air exerts a force on the golf ball that affects its trajectory. The aerodynamic force has three components as shown in FIG. 1. One component is the drag $F_D$, which is parallel and opposite in direction to the motion of the golf ball $G_M$. The other two components are the lift $F_L$, which is perpendicular to the drag and is almost aligned with the vertical direction, and the lateral force $F_S$, which is perpendicular to both the drag and lift forces (i.e., normal to the drawing page). The drag and lift coefficients $C_D$ and $C_L$, respectively, are defined as $C_D=F_D/(\frac{1}{2}\rho U^2)$, and $C_L=F_L/(\frac{1}{2}\rho U^2)$, where $\rho$ is the density of the air $A_M$ in which the golf ball $G_M$ is traveling.

SUMMARY

An aspect of the present disclosure provides for an improved golf ball having low dimple coverage and a low drag coefficient to improve flight characteristics of the golf ball.

In one implementation, the present disclosure provides a method of determining the optimum number of dimples on a spherical surface. The method includes providing at least two spheres each having a plurality of dimples on its surface. Then generating a drag curve for each sphere and a lift curve for each sphere. A trajectory analysis for each sphere is then conducted and the results are for each sphere are compared.

The method can further include generating the drag curve by determining the coefficient of pressure over the polar angle for each sphere and then taking the integral of coefficient of pressure over the polar angle for each sphere.

The method can further include where the trajectory analysis includes launch parameters for the spheres. The launch parameters can include selecting a launch speed, launch angle, and spin rate.

The method can also include providing at least two spheres have a different number of dimples on its surface. Alternatively, or in addition to, the two spheres could have different dimple shapes and/or sizes.

BRIEF DESCRIPTION OF DRAWINGS

Embodiments of the invention will now be described, by way of example only, with reference to the accompanying drawings in which corresponding reference symbols indicate corresponding parts.

DETAILED DESCRIPTION

Figure 1:
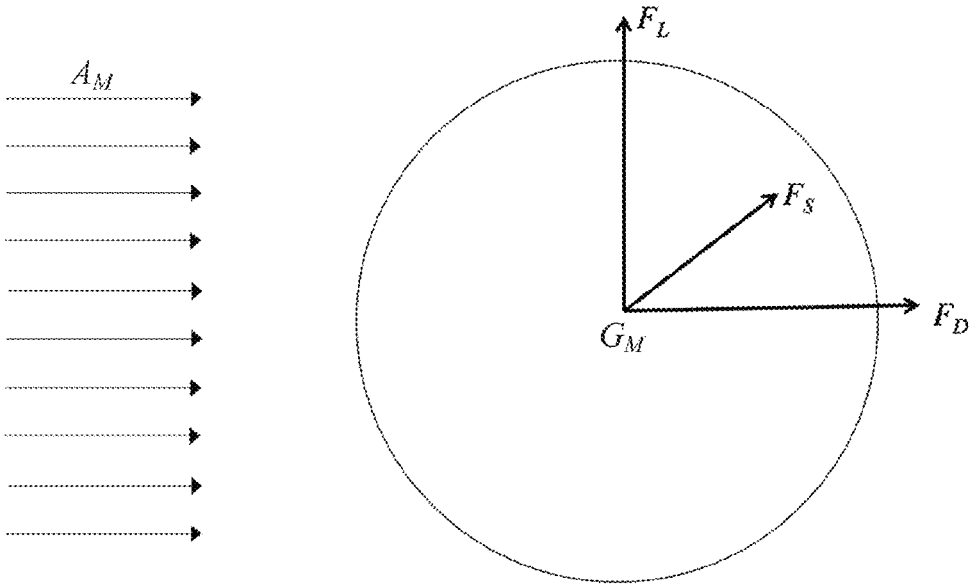
FIG. 1 is a schematic illustrating the drag, lift, and lateral aerodynamic forces acting on a ball.

The present disclosure describes a golf ball having low dimple coverage and decreased drag compared to conventional golf balls and a method of designing a golf ball by placing dimples on a sphere. Dimples are used to lower the drag compared to a smooth sphere. However, each dimple imposes a drag penalty on the golf ball. Described in this disclosure are a number of embodiments that optimize the number and placement of dimples on a smooth sphere to reduce the amount of drag on the golf ball.

In one embodiment, the present disclosure provides a golf ball including a spherical outer surface having a ball diameter that is the golf ball's maximum diameter, and a plurality of dimples formed into the outer surface and arranged into a substantially symmetrical pattern entirety around the outer surface, each of the plurality of dimples having a corresponding dimple depth and a corresponding dimple diameter, less than 70% of the outer surface being covered by the plurality of dimples. The dimple depth may be less than or equal to about 0.01 times the ball diameter. The dimple diameter may be less than one-tenth of the ball diameter. The plurality of dimples may each be formed as a conical frustum, or may have a spherical geometry. The plurality of dimples may cover less than 44% and/or more than 18% of the outer surface. The plurality of dimples may express icosadeltahedral symmetry.

The plurality of dimples may number between 110 and 272, inclusive. Each dimple may be oriented at a corresponding vertex of an icosahedron having an equal number of vertices to the number of dimples. Or, the plurality of dimples number between 110 and 194, inclusive, and each dimple of the plurality of dimples may be oriented at a corresponding vertex of an octahedron having an equal number of vertices to the number of dimples. The plurality of dimples may consist of a first number of the dimples, and a solution to the Thomson problem for placing the first number of electrons on a sphere may be used to position the first number of dimples on the outer surface, each dimple of the first number of dimples having a corresponding electron of the first number of electrons.

In other embodiments, the present disclosure provides a golf ball including a spherical outer surface having a first diameter, and a plurality of dimples formed into the outer surface and arranged around the outer surface, between 18% and 61% of the outer surface being covered by the plurality of dimples. The plurality of dimples may number between 120 and 272, inclusive, and each dimple may be oriented at a corresponding vertex of an icosahedron having an equal number of vertices to the number of dimples. The plurality of dimples may express icosadeltahedral symmetry around the outer surface. The plurality of dimples may be spherical and may have a uniform second diameter less than one-tenth of the first diameter. Or, the plurality of dimples may number between 110 and 272, inclusive, and may have a uniform depth of at least 0.0087 times the first diameter.

An aggregate dimple volume, measured as the sum of a dimple volume of each dimple of the plurality of dimples, may be between 0.38% and 1.61%, inclusive, of a volume of a smooth sphere having the first diameter. The plurality of dimples may have a uniform depth greater than 0.0065 times the first diameter. A first dimple of the plurality of dimples may include a dimple surface that intersects the outer surface of the golf ball, and a rim formed at the intersection of the dimple surface with the outer surface, the rim including either or both of: one or more recesses formed into the rim; and one or more protrusions extending away from the rim.

Figure 2:
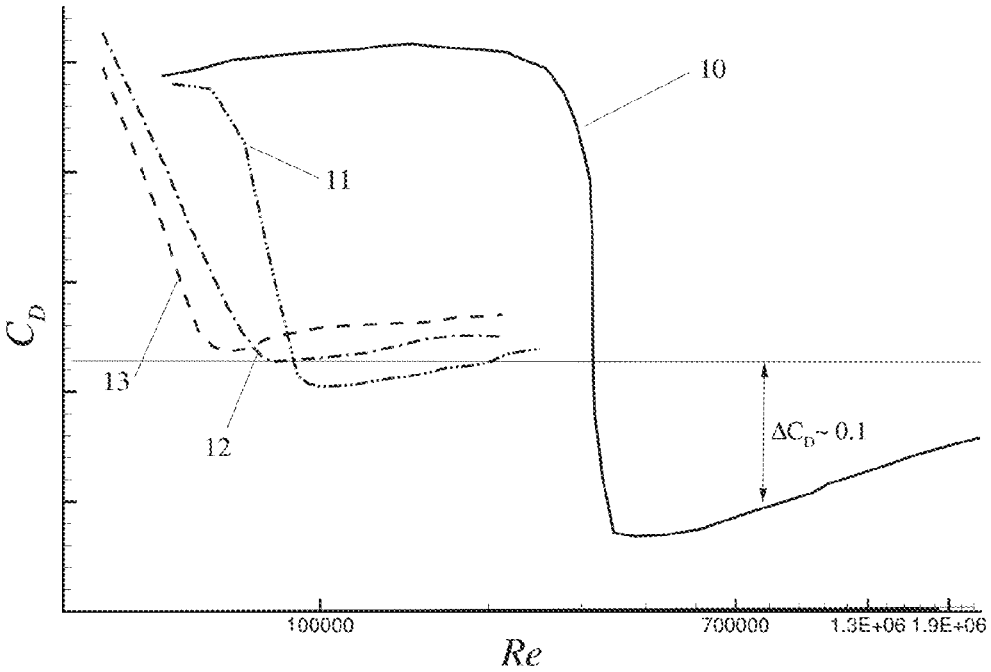
FIG. 2 is a plot of the drag coefficient versus the Reynolds number for a stationary smooth sphere, a conventional golf ball with circular dimples, a Uniroyal Plus 6 golf ball, a Titleist DT-Distance golf ball, and a Srixon golf ball.
Figure 3A:
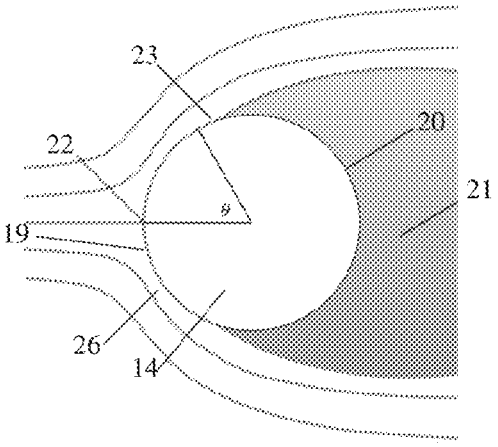
FIG. 3A is a schematic illustrating boundary layer behavior and flow separation for a subcritical regime of a golf ball in flight.
Figure 3B:
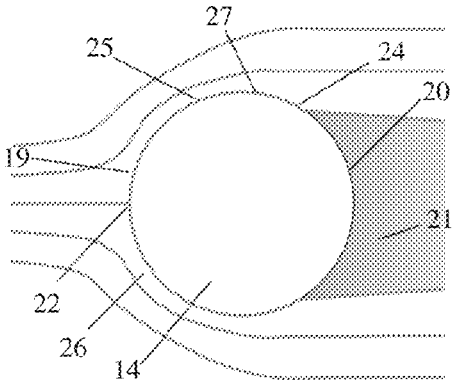
FIG. 3B is a schematic illustrating boundary layer behavior and flow separation for a supercritical regime of a golf ball in flight.
Figure 3C:
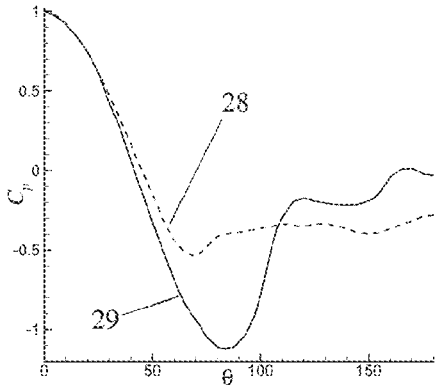
FIG. 3C is a plot showing a distribution of the pressure coefficient over the sphere for the subcritical regime of FIG. 3A and the super critical regime of FIG. 3B.

FIG. 2 shows a plot 10 of the drag coefficient ($C_D$) versus Reynolds number for a smooth sphere 14, a traditional golf ball 15 with circular dimples, a golf ball 16 with hexagonal dimples, and a golf ball 17 with 392 circular dimples. The coefficient of drag can generally be divided into three regions: a pre-drag crisis region, a drag crisis region, and a post-drag crisis region. For a smooth sphere 14, the pre-drag crisis, also known as the subcritical regime, includes the lower range of Reynolds numbers up to approximately Re=300,000. The coefficient of drag for a smooth sphere 14 in this region remains almost constant, at approximately $C_D$=0.52. As the Reynolds number increases, the coefficient of drag starts to drop quickly and reaches a minimum of $C_D$=0.08 at around Re=400,000. The Reynolds number associated with the minimum coefficient of drag is known as the critical Reynolds number ($Re_{cr}$). The region around the critical Reynolds number is referred to as the drag crisis or critical regime. As the Reynolds number continues to increase, the coefficient of drag begins to gradually increase, reaching a value just below $C_D$=0.2. This is the post-drag crisis or supercritical regime. Two schematics and a plot illustrating the main differences between the subcritical and supercritical regimes and why there is such a big drop in the drag coefficient are shown in FIGS. 3A, 3B, and FIG. 3C. FIG. 3A is a schematic illustrating boundary layer behavior and flow separation for the subcritical regime. FIG. 3B is a schematic illustrating boundary layer behavior and flow separation for the supercritical regime. FIG. 3C is a plot of the pressure coefficient over the sphere 14 for the two regimes. The pressure coefficient $C_p$ is defined as $p=(\frac{1}{2}\rho U^2)$, where p is the static pressure.

Referring now to FIG. 3A, the flow around a smooth sphere 14 in the subcritical regime is shown. The boundary layer is the layer of fluid in the immediate vicinity of a surface where the effects of viscosity are significant. The boundary layer around the sphere 14, as shown in FIG. 3A, is a laminar boundary layer 26, that separates from the sphere 14 at a point 23 on the sphere which is around θ=85°, where θ is the polar angle measured from the stagnation point 22 on the front 19 of the sphere. That is, in the subcritical regime the separation point 23 is closer to the front 19 than the back 20 of the sphere, which creates a wide wake 21. In the supercritical regime, as shown in FIG. 3B, the boundary layer is initially a laminar boundary layer 26 but transitions at a point 25 before flow separation to a turbulent boundary layer 27 at around θ=60-90°. Turbulent activity in the turbulent boundary layer 27 creates momentum transport of high speed fluid (e.g., air) towards the ball, which helps overcome the adverse pressure gradient, due to a static pressure increase in the direction of the air flow over the sphere 14, and shifts separation significantly toward the back 20 of the sphere 14. The boundary layer separates at the separation point 23 at around θ=120°, resulting in a more streamlined flow with a smaller wake 21. In both regimes, due to the high Reynolds number, the majority of the drag comes from the pressure distribution around the sphere 14. A plot of the average pressure coefficient $C_p$ versus polar angle θ from the front 19 of the sphere 14 to the back 20 of the sphere 14 for both the subcritical regime 28 and the supercritical regimes 29 is shown in FIG. 3C. The plot of the change in the coefficient of pressure over the polar angle for the subcritical regime is shown as line 28. The plot of the change in the coefficient of pressure over the polar angle for the supercritical regime is shown as line 29. The pressure on the front part of the sphere 14 is lower in the supercritical regime as a result of higher velocities in the turbulent boundary layer 27. In addition, the pressure at the back 20 of the sphere 14 recovers to higher values due to the delayed separation 24 contributing to a lowering of drag.

The golf ball plots 11, 12, and 13 in FIG. 2 show that the behavior of the drag coefficient is different than it is for the smooth sphere plot 10. The same three regions, namely the subcritical, critical, and supercritical regimes, exist for the other golf ball plots 11, 12, and 13, but the drag crisis occurs at a lower Reynolds number. The Reynolds number where the drag crisis occurs can vary for golf balls depending on the dimple shape and dimple pattern of the particular golf ball. In general, however, the critical Reynolds number varies between $Re_{cr}$=70,000-100,000 for the golf ball plots 11, 12, and 13, while for the sphere plot 10 it is $Re_{cr}$=400,000. It is believed that the dimples cause the boundary layer to transition at a much lower Reynolds number and can therefore accelerate the drag crisis. However, the drag coefficient in the supercritical regime for the plots 11, 12, and 13 of the golf balls are not as low as that for the sphere plot 10 in the supercritical regime. For the sphere plot 10, the drag coefficient is below $C_D$=0.2 and can be as low as $C_D$=0.08. For the golf ball plots 11, 12, and 13, the drag coefficient varies between $C_D$=0.22 and $C_D$=0.28, depending on the dimple design of the golf balls of the plots 11, 12, and 13. Therefore, there is a difference in the drag coefficient of approximately $AC_D$=0.1 between the golf balls plots 11, 12, and 13 and the sphere plot 10 in the respective supercritical regimes.

Figure 5A:
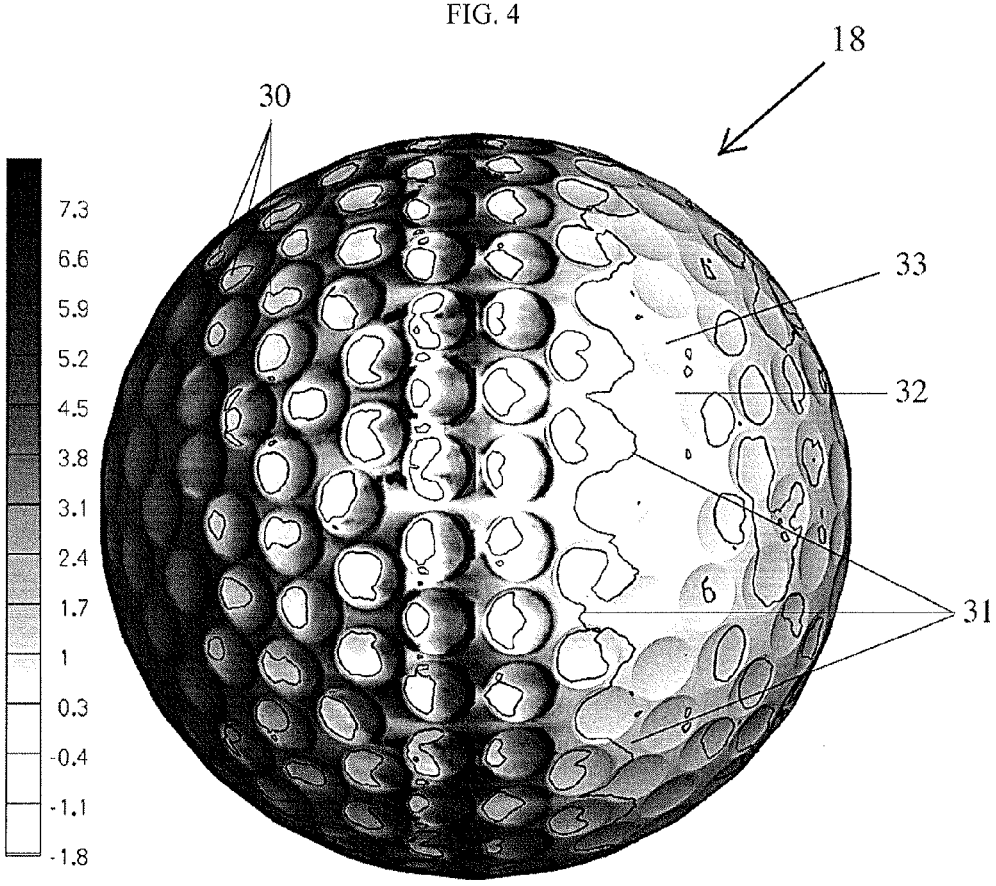
FIG. 5A is a plot of the contours of the coefficient of friction scaled by $Re^{0.5}$ on a traditional golf ball.
Figure 5B:
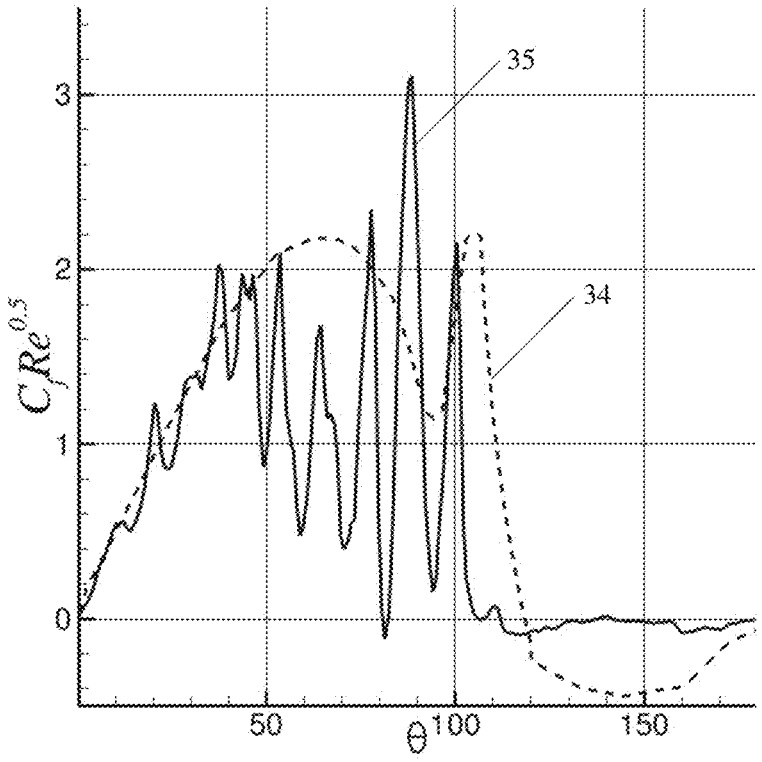
FIG. 5B is a plot of the coefficient of friction averaged over the azimuthal angle versus the polar angle for a traditional golf ball and a smooth sphere.

Referring now to FIGS. 5A and 5B, contours of the skin friction coefficient $C_f$ scaled by $Re^{0.5}$ over a traditional golf ball 18 having 312 spherical dimples are shown. "Spherical," in the sense used herein to describe the dimples of golf balls, means the dimple is concave and formed with a geometry as if an intersection between the golf ball outer surface and a second sphere were removed from the golf ball. The skin friction coefficient is defined as $\tau_w/(\frac{1}{2}\rho U^2)$, where $\tau_w$ is the local wall shear stress. The dimples (e.g., dimple 33) have a diameter of d=0.095 D and a maximum depth k=0.0067D, where D is the golf ball diameter. The golf ball 18 has a dimple coverage of approximately 70%, which is comparable to most commercially available golf balls on the market. The dimple coverage is defined as the percent of area covered by dimples to the total surface area of a smooth sphere of the same diameter as the golf ball. In FIG. 5A areas of flow separation 30 are indicated by solid curved lines. As shown in FIG. 5A, the traditional golf ball 18 incurs localized separation at separation points 30 in the dimples as early as about θ=45°. Separation continues to occur within each dimple after that. The local separation points 30 are consistent with the formation of shear layers in the onset of transition triggered by the dimples. Complete global separation occurs along a jagged separation line 31 towards the rear of the golf ball 18, as shown in FIG. 5A.

Figure 4:
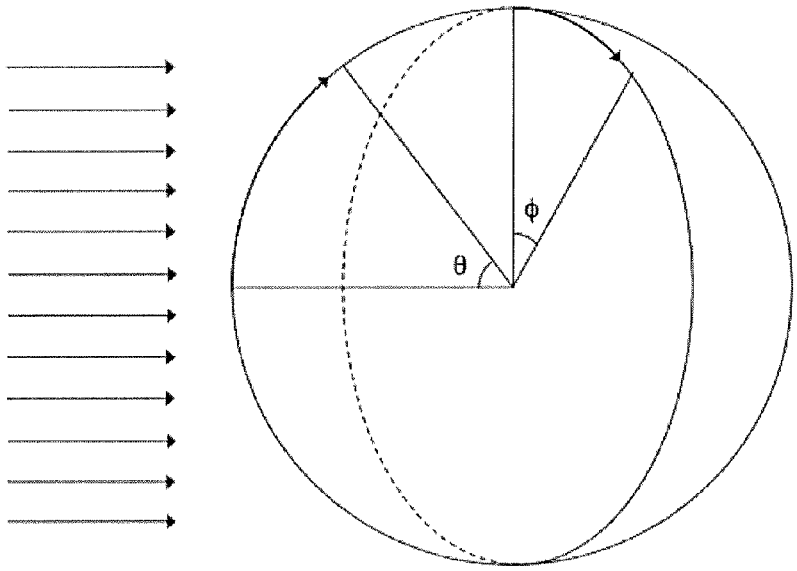
FIG. 4 is a schematic illustrating the polar and azimuthal angles on a ball in a spherical coordinate system.

When the flow separates, the skin friction coefficient decreases in value and becomes negative inside the dimples, but then rises past the trailing edges of the dimples. The separation line varies significantly in the azimuthal depending on the dimple arrangement. The azimuthal is an angular measurement in a spherical coordinate system, where a vector between the center of the sphere and a point of interest is projected perpendicularly onto a reference plane, and where the angle $\phi$ between the projected vector and a reference vector on the reference plane is the azimuth as shown in FIG. 4. The separation line 31 can occur as late as $\theta=120°$ at some azimuthal locations, which is similar to the case of a sphere 14 in the supercritical regime. When averaged over the azimuthal coordinate though, global separation occurs around $\theta=113°$, which is slightly earlier than for the sphere 34, as shown in FIG. 5B, which shows a plot of the skin friction coefficient averaged over the azimuthal angle versus the polar angle $\theta$ for the golf ball plot 35 and the smooth sphere plot 34.

Figure 6A:
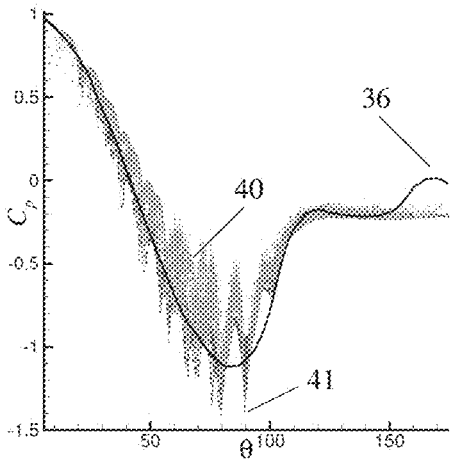
FIG. 6A is a plot of the average pressure coefficient plotted versus the polar angle.
Figure 6B:
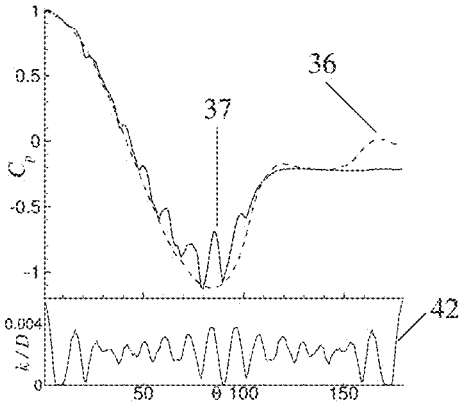
FIG. 6B is a plot of the pressure coefficient over the azimuthal coordinate.

In the supercritical regime, most of the drag comes from the pressure and less than 10% comes from the skin friction on the surface of the golf ball. Therefore any differences in the total drag between the traditional golf ball 18 and the sphere 14 should be reflected in the pressure coefficient. A plot of the time averaged pressure coefficient $C_p$ versus polar angle $\theta$ measured from the stagnation point 22 for a land area plot 41 of the golf ball 18, dimpled area plot 40 of the golf ball 18, and the smooth sphere plot 36 are shown in FIG. 6A. The pressure coefficient on the land area plot 41 (the non-dimpled areas, see FIG. 5A) and the dimple area plot 40 are plotted separately to better understand the effect of the dimples 33 on the pressure. The distribution of the pressure coefficient for the sphere plot 36 in the supercritical regime is super-imposed on the same graph for comparison. The pressure on the traditional golf ball 18 fluctuates considerably, but compared to the smooth sphere 14, the pressure coefficient is for the most part higher inside the dimples 33 and lower in the land area 32. A golf ball plot 37 of the pressure coefficient on the traditional golf ball 18 averaged over the azimuthal angle is shown in FIG. 6B, with an average depth plot 42 of dimples 33. The average dimple 42 depth is the average depth of all the dimples 33 for a given polar angle. The fluctuations of the pressure coefficient are clearly observed in this plot too, they are relatively smaller near the stagnation point 22 but increase as the polar angle $\theta$ increases with the highest fluctuations taking place around $\theta=90°$. Also, the peaks in the pressure coefficient correlate with peaks in the average depth. As the average depth plot 42 approaches zero, which is closer to the land area 32, the pressure coefficient drops and approaches that of the sphere plot 36. Overall, though, the pressure on the traditional golf ball 18 is consistently higher on the front part of the traditional golf ball 18 and up to the separation line 31 around $\theta=120°$. This is important because it demonstrates that the dimples 33 on the traditional golf ball 18 incur a local pressure penalty compared to a smooth sphere 14.

Figure 6C:
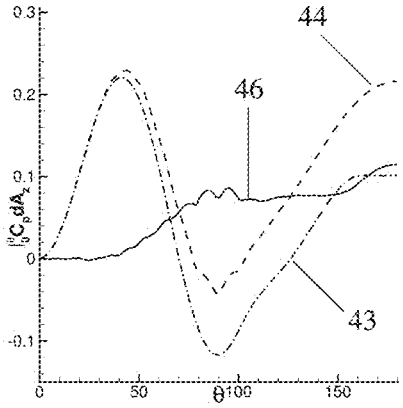
FIG. 6C is a plot of the integral of the coefficient of pressure over the projected surface area as a function of the polar angle.

After separation occurs, the base pressure at the back 20 of the traditional golf ball 18 does not exhibit any fluctuations and remains close in value to that of the sphere 14. This is consistent with the observation that the average separation line 31 on the traditional golf ball 18 is close to that of a sphere 14. Finally, the integration of the pressure over the projected surface area of the traditional golf ball 18 and the sphere 14 are plotted as a golf ball plot 37 and a sphere plot 36 and a difference plot 39 showing the difference between the two plots is shown in FIG. 6C. The integral is plotted versus polar angle $\theta$, and when evaluated over the entire surface (i.e., $\theta=0-180°$, gives the total drag coefficient due to pressure. The difference plot 46 helps identify the source of the drag penalty. Initially, the pressure integrals up to $\theta=45°$ show that the dimple 33 on the very front of the traditional golf ball 18 (i.e., $\theta=0°$ and at the stagnation point 22) does not impose a pressure penalty. The main drag penalty comes from the dimples 33 located between $\theta=45°$ and $\theta=90°$. In this region the pressure overhead of the dimples 33 becomes very important and by this location the drag surplus of the dimples 33 is about 0.1, which is approximately the total drag difference between the traditional golf ball 18 and the sphere 14. To put it in perspective, the cumulative pressure overhead of the dimples 33 in the front 19 of the traditional golf ball 18 is almost equal to the total drag of the sphere 14 in the super-critical regime. This analysis is very crucial in understanding the role of the dimples 33 in the drag reduction process. Although dimples 33 can accelerate the drag crisis and reduce drag by 50% compared to a smooth sphere 14, at the same Reynolds number they also impose a drag 'penalty'. It would be advantageous to identify the optimum number and position of dimples to minimize the drag penalty on a golf ball.

It should be noted that truly equally spaced points on a sphere 14 are limited to configurations with a predetermined number of points, such as octahedron, dodecahedron and icosahedron, which have 8, 12, and 20 vertices, respectively. For an arbitrary number of points, the methodology of placing the dimples 33 on a sphere 14 is very similar to the Thomson Problem. In the Thomson Problem, the location of the points is found by determining the minimum energy configuration of N electrons on the surface of a sphere that repel each other with a force given by Coulomb's law. The dimples 33 are then placed such that the dimple centers coincide with the location of the points (i.e., electrons). This method was used to place 120 spherical dimples 33 onto a sphere. The result is a design with dimples 33 that are quasi-equally spaced and quasi-symmetric. The latter is very important, since USGA sets a symmetry test for USGA sanctioned golf balls. The test involves measuring the deviation in flight performance when the golf ball is launched under specific conditions but is placed on the tee either in poles-over-poles or in poles horizontal orientation. It should be noted that other methods for accounting for the minimum energy configuration can be used such as replacing the electrostatic force with a spring model to produce similar results.

Figure 7:
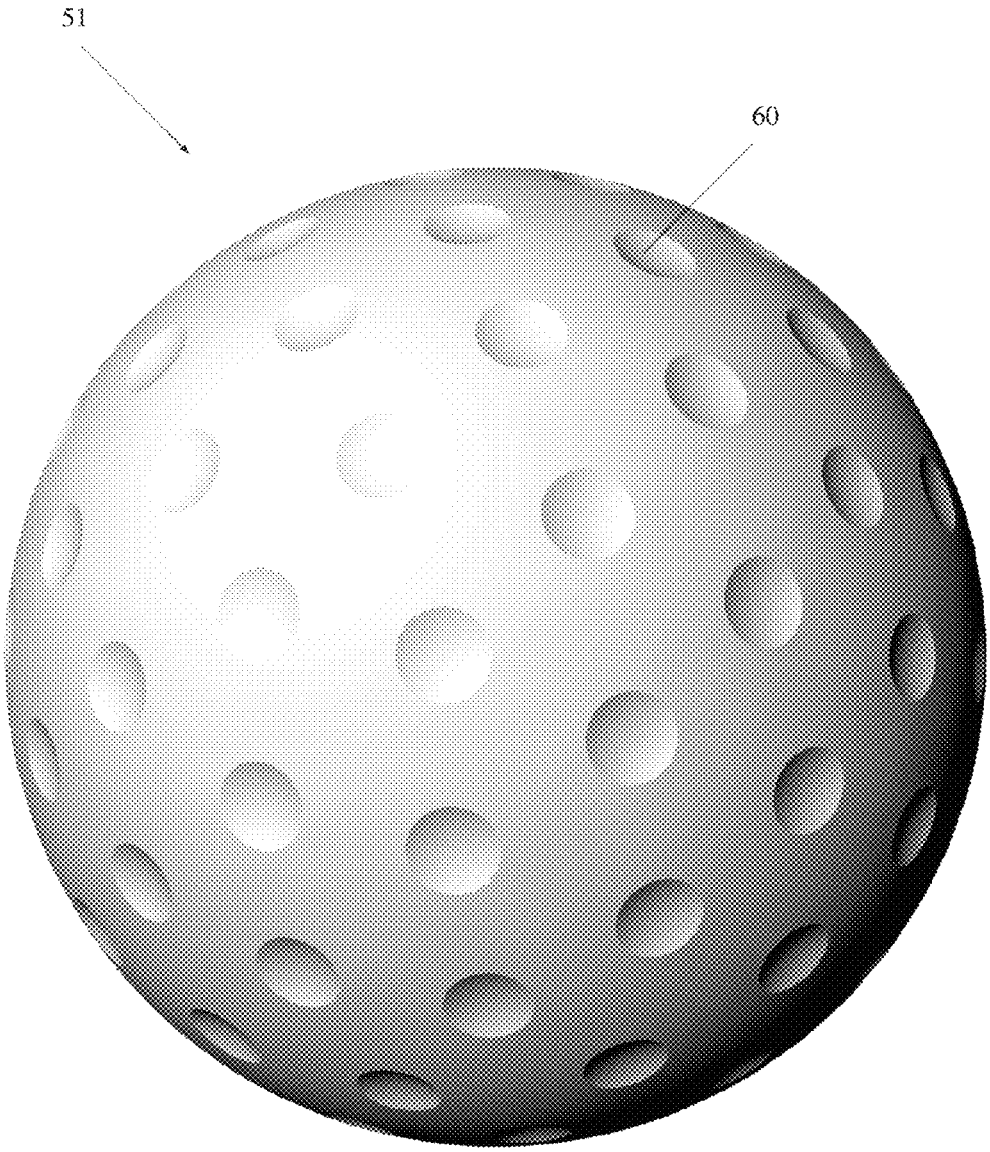
FIG. 7 is a diagram of a low drag golf ball having 120 quasi-equally spaced spherical dimples.

FIG. 7 illustrates a first exemplary embodiment for an improved golf ball 51 having a dimple coverage area that is lower than that of commercial golf balls, and in particular lower than about 70%. The golf ball 51 is a sphere having a diameter D, and contains 120 quasi-equally spaced spherical dimples 60; that is, the dimples 60 are laid out with an approximately even distribution, the distance between dimples 60 being as uniform as reasonably possible in a distribution of an arbitrary number of points. The golf ball 51 has a dimple diameter of d=0.079D and a dimple depth of k=0.0087D. The resulting dimple 60 coverage of the golf ball is 18.6%.

Figure 8A:
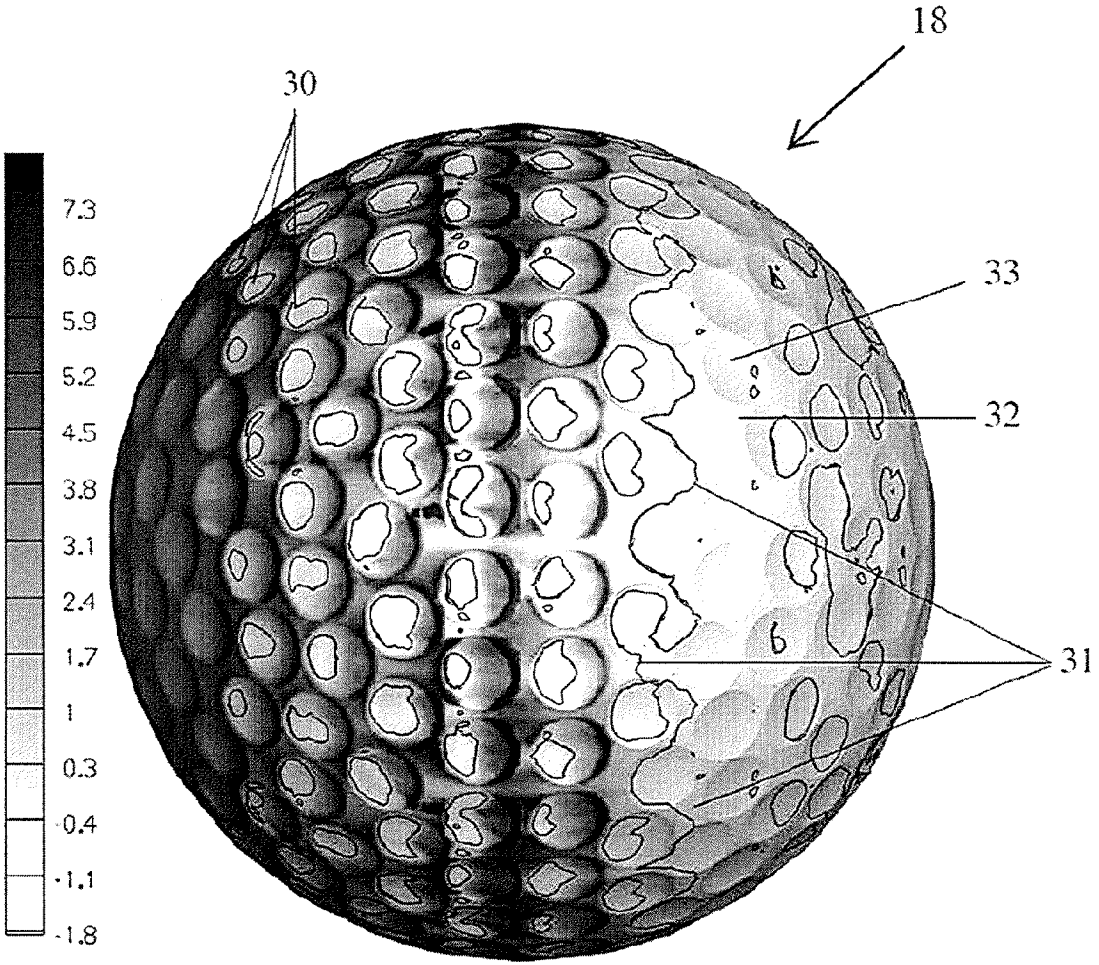
FIGS. 8A and 8B are plots of the contours of time averaged skin friction scaled by $Re^{0.5}$ on the traditional golf ball of FIG. 5A and the low drag golf ball of FIG. 7, respectively.
Figure 8B:
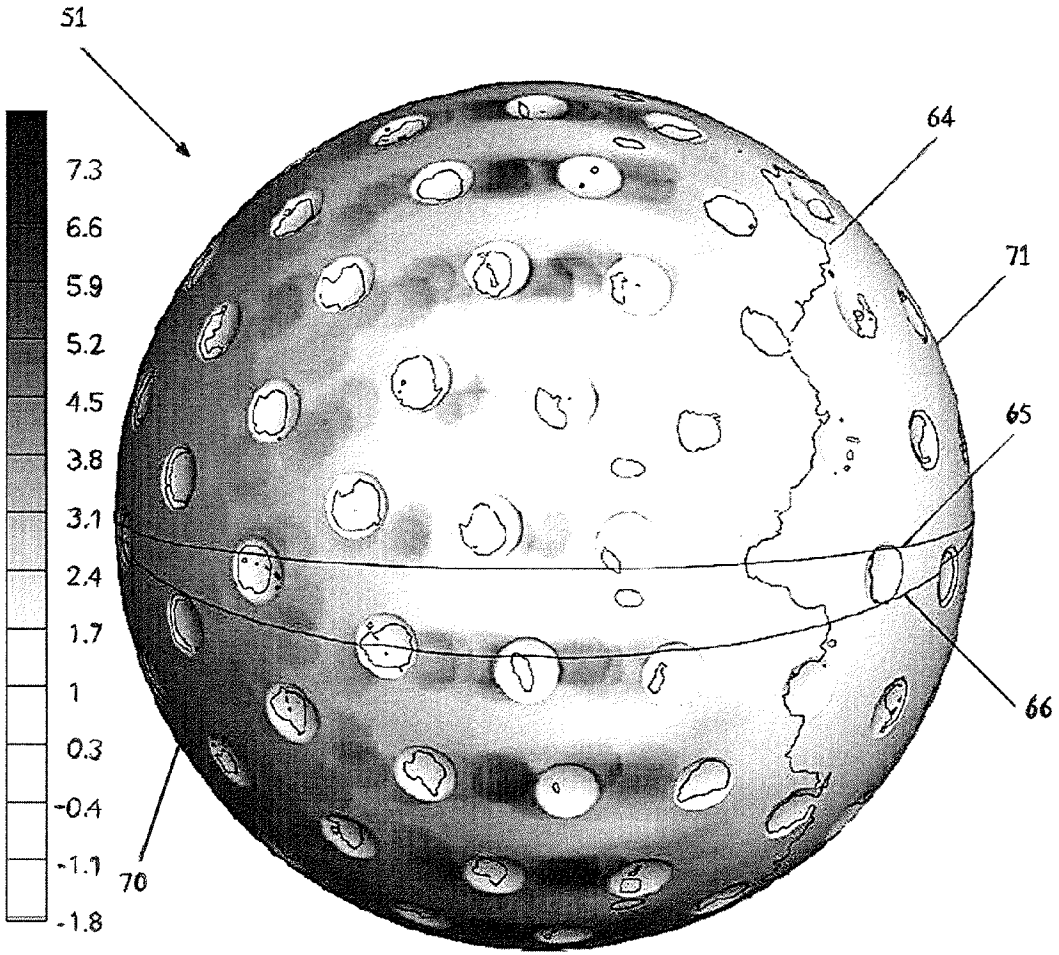
Figure 9A:
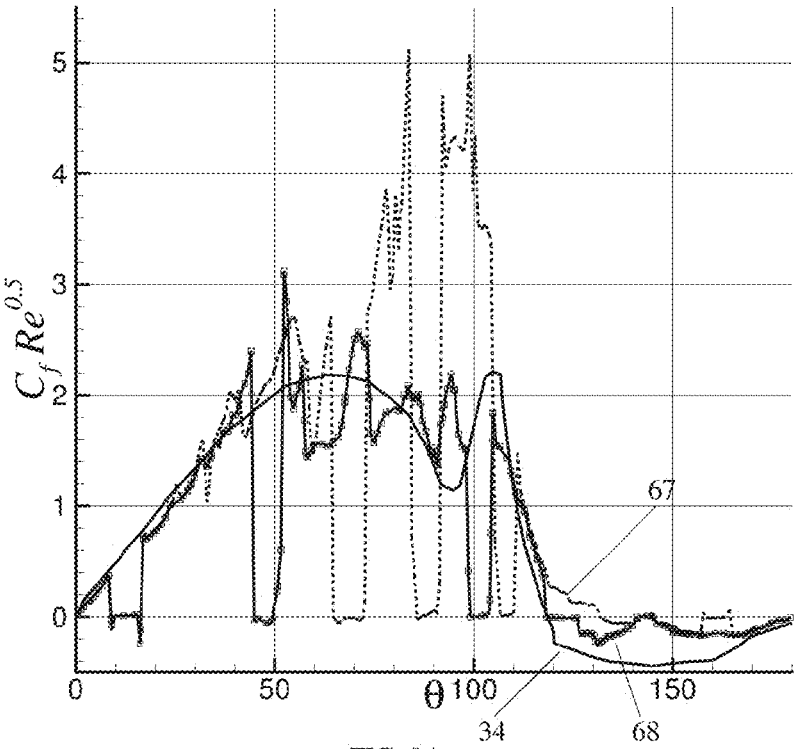
FIG. 9A is a plot of the time averaged friction coefficient versus the polar angle along a first azimuthal line and a second azimuthal line for the low drag golf ball of FIG. 7.
Figure 9B:
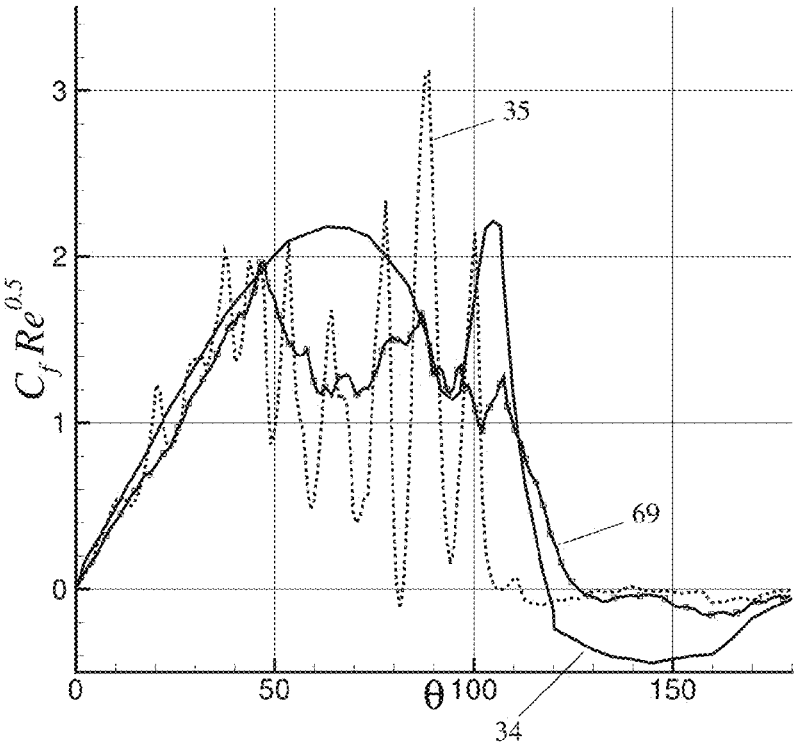
FIG. 9B is a plot of the time averaged friction coefficient averaged in the azimuthal and plotted versus the polar angle.

With a Reynolds number of Re=200,000 in the supercritical regime, the average drag coefficient of the golf ball 51 is 0.17, or 26% lower than the drag coefficient for the traditional golf ball 18 discussed in the background. Referring to FIGS. 8A and 8B, the contours of the time averaged skin friction coefficient on both the traditional golf ball 18 (FIG. 8A) and the first embodiment golf ball 51 (FIG. 8B0 are shown. For the golf ball 51, the peak values of skin friction coefficient are not as elevated as for the traditional golf ball 18, however, the separation line 64 at the back of the golf ball 51 is shifted significantly toward the rear of the ball 71 and global separation is delayed. There is also a significant variation of the separation line 64 in the azimuthal direction. FIG. 9A shows a plot 67 of the skin friction coefficient versus polar angle θ on the azimuthal line 65 and a plot 68 of the skin friction coefficient versus polar angle θ on the azimuthal line 66 on the golf ball 51, shown in FIG. 8B, and clearly shows the variation of the separation line 64 along these lines 67 and 68 compared to the sphere plot 34. For the plot 67, the flow separates globally around θ=118°, which coincides with the presence of a dimple 60. On the contrary, for the plot 68, no dimples 60 are present on the line 66 around the same polar angle, and the separation line 31 is farther delayed at θ=131°. On average, the separation line 31 shown in FIG. 9B for the golf ball 51 occurs at θ=125°, compared to θ=118° for the sphere plot 34 and θ=113° for the golf ball plot 35.

Figure 10A:
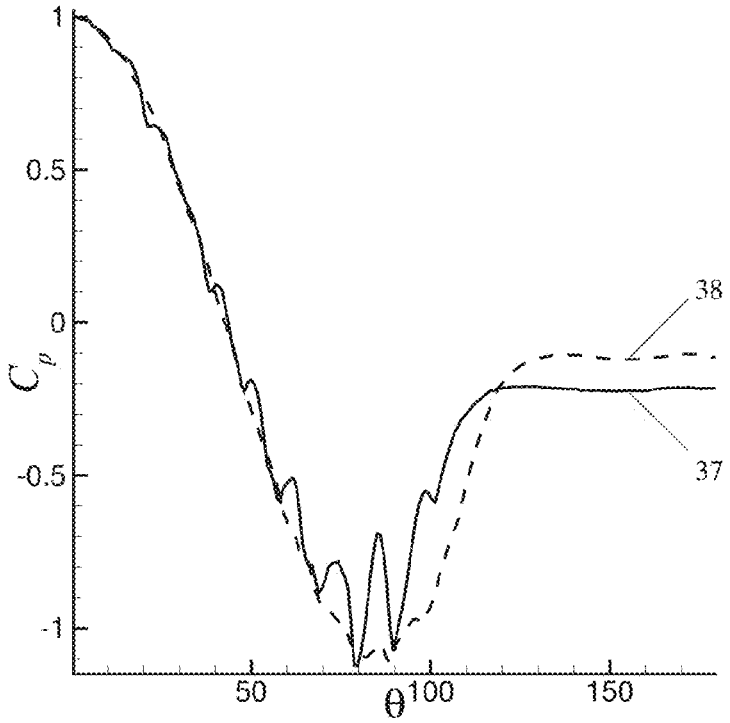
FIG. 10A is a plot of the pressure coefficient averaged over time and azimuthal coordinate versus polar angle for a traditional golf ball and the low drag golf ball of FIG. 7.
Figure 10B:
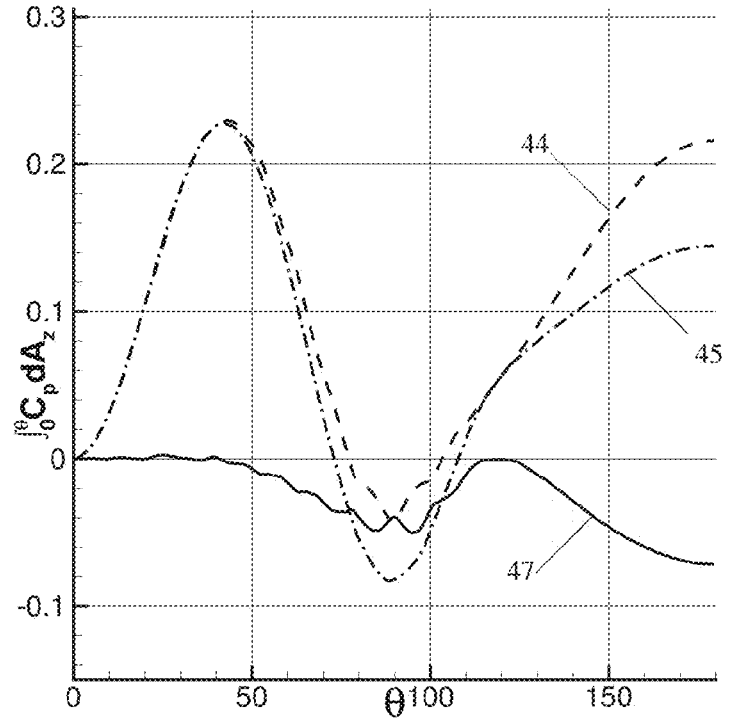
FIG. 10B is a plot of the integral of the pressure coefficient over the projected surface area as a function of the polar angle for a traditional golf ball and the low drag golf ball of FIG. 7.
Figure 11A:
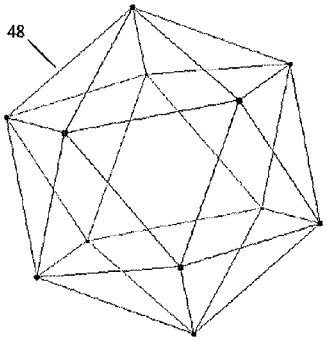
FIG. 11A is a diagram of the icosahedron used, in accordance with the present disclosure, to create the icosadeltahedral structures for the golf ball embodiments shown in perspective view in FIGS. 11B-E: a golf ball embodiment having 92 dimples, as shown in FIG. 11B; a golf ball embodiment having 162 dimples, as shown in FIG. 11C; a golf ball embodiment having 272 dimples, as shown in FIG. 11D; and a golf ball embodiment having 392 dimples as shown in FIG. 11E.
Figure 11B:
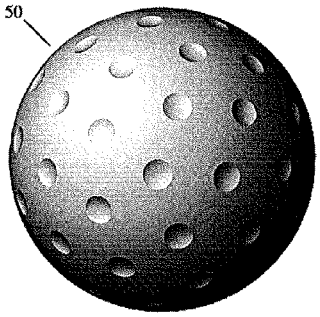
Figure 11C:
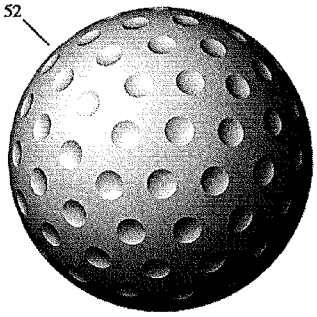
Figure 11D:
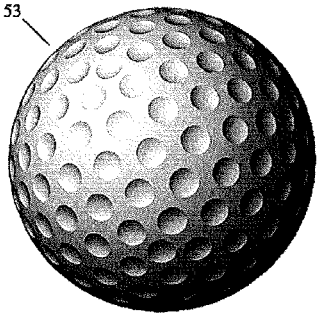
Figure 11E:
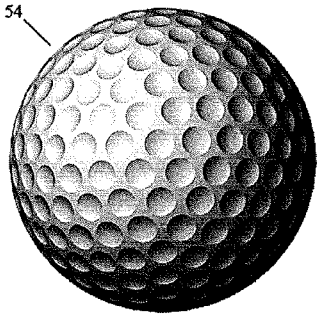

The effect of using fewer dimples 60 on the coefficient of pressure is shown in FIGS. 10A and 10B. FIG. 10A plots the coefficient of pressure over the polar angle for a traditional golf ball 18 (plot 37) and the golf ball 51 of FIG. 7 (plot 38). When the coefficient of pressure is averaged over the azimuthal direction, the oscillations for the golf ball 51 are significantly reduced compared to the traditional golf ball 18. In addition the coefficient of pressure for the golf ball 51 is lower than that of the golf ball 18 at the front part of the ball. This confirms the concept that dimples 60 incur a pressure penalty; reducing the number of dimples 60 on the golf ball 51 causes the coefficient of pressure to be reduced too. Also, for the case of the golf ball 51, the coefficient of pressure at the back of the golf ball 51 recovers more quickly as a result of the delayed separation, yielding a higher back pressure compared to the traditional golf ball 18. In addition the coefficient of pressure for the golf ball 51 is consistently lower than that of the traditional golf ball 18, especially in the front part and in the back up to the separation point 64.

The integral of the coefficient of pressure over the projected surface area of the golf ball yields the coefficient of drag due to pressure. The difference plot 47 between the integral of the coefficient of pressure of the golf ball embodiment plot 45 and the traditional golf ball plot 44 is shown in FIG. 10B. The decrease in drag is obvious in the difference plot 47. In the front part of the golf ball 51, the contribution to the drag drop is 0.04, while an additional 0.03 drop takes place due to the higher back pressure. This analysis clearly demonstrates that reducing the dimple 60 coverage on the golf ball 51 reduces the drag in two ways: first by reducing the pressure penalty from dimples of the ball on the front part, and second by shifting the separation point 64 rearward and allowing for a greater pressure recovery at the back 71 of the golf ball 51.

Having clearly identified a source of drag penalty for golf balls and how to reduce the drag by reducing the number of dimples 60, the drag and lift of the golf ball 51 can be controlled by adjusting the dimple 60 parameters, such as the number of dimples 60, the shape of the dimples 60, the size of the dimples 60, and the depth of the dimples 60. As shown in FIGS. 11A-E, additional embodiments are shown having a different number of dimples 60. For example: golf ball 50 has 92 spherical dimples 60, golf ball 52 has 162 spherical dimples 60, golf ball 53 has 272 spherical dimples 60, and golf ball 54 has 392 spherical dimples 60. In each embodiment the dimple diameter is d=0.079D and the dimple depth is k=0.0087D, which is the same as with the golf ball 51 of FIG. 8B. All the embodiments are based on icosadeltahedral structures which are obtained by dividing the triangular faces of an icosahedron 48 into smaller, symmetrical triangles, thus maintaining icosahedral symmetry. The dimple coverage and depth percentage are listed in FIG. 13. The dimple coverage starts at 14.3% for the golf ball 50 and linearly increases to 60.8% for golf ball 54. For the golf ball 54 of FIG. 11E having the highest dimple 60 coverage, the dimple 60 coverage is at the low end of today's commercial golf balls. The dimple 60 volume is defined as the percentage of volume of the dimples 60 divided by that of a smooth sphere 14 and varies from 0.38% to 1.61%.

Figure 12A:
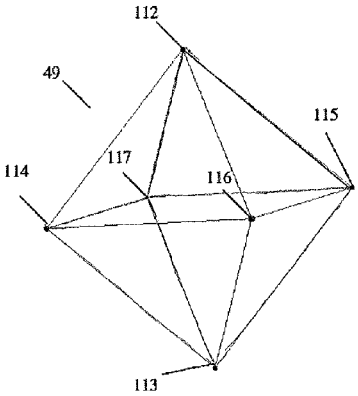
FIG. 12A is a diagram of the octahedron used, in accordance with the present disclosure, to create the octahedral structures for the golf ball embodiments shown in perspective view in FIGS. 12B and 12C: a golf ball embodiment having 110 dimples, as shown in FIG. 12B; and a golf ball embodiment having 194 dimples, as shown in FIG. 12C.
Figure 12B:
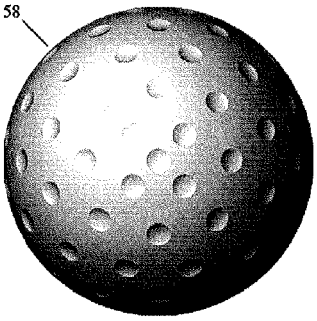
Figure 12C:
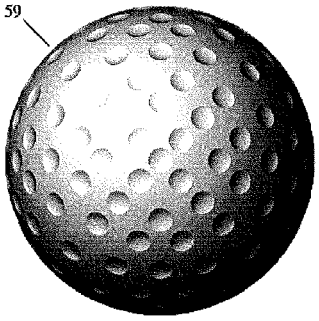

Referring to FIGS. 12A-C, golf ball embodiments with low dimple coverage can also be based on octahedral structures which are obtained by dividing the triangular faces of an octahedron 49 (see FIG. 12A) into smaller triangles. Two such golf ball embodiments 58 and 59, with 110 and 194 spherical dimples 60 respectively, are shown in FIGS. 12B and 12C, respectively. The advantage of this method is that the golf ball embodiments 58 and 59 maintain an icosahedral symmetry which is important for meeting the USGA symmetry test requirements. The test involves measuring the deviation in flight performance when the golf ball is launched under specific conditions but is placed on the tee either in poles-over-poles or in poles horizontal orientation. If one defines the poles of the golf ball embodiments 58 and 59 as any pair of opposite points 112-113, or 114-115, or 116-117 of the original octahedron, then the golf ball embodiments 58 and 59, either in poles-over-poles or in poles horizontal orientation, are exactly identical and are therefore expected to have the same flight characteristics. In fact any rotation of the ball embodiments 58 or 59 by 90° about a vertical or horizontal axis results in an identical dimple configuration.

Figures 13, 14:
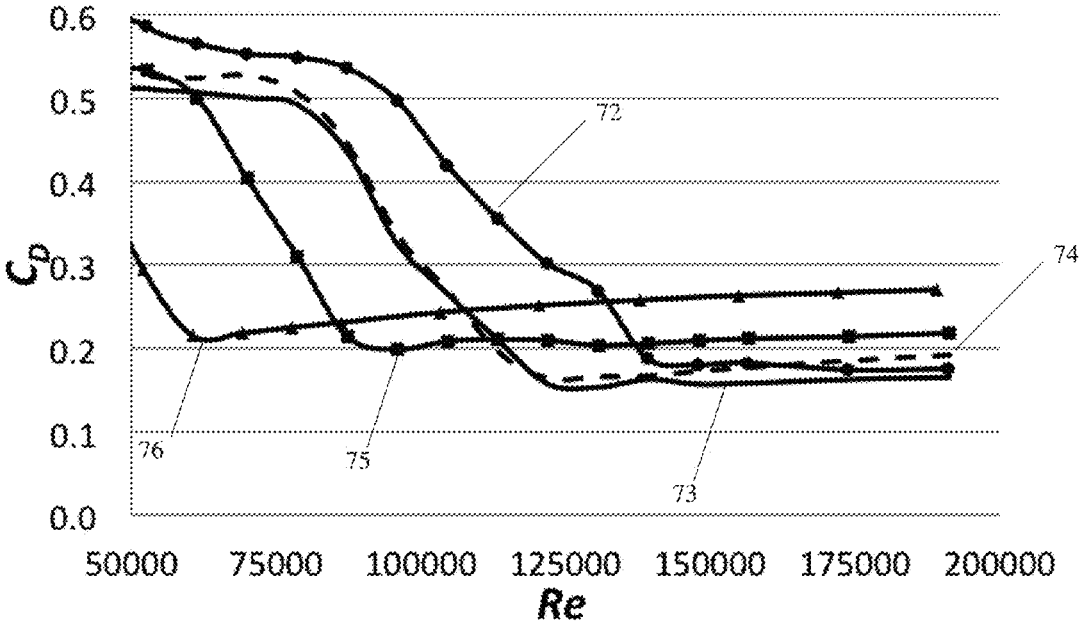
FIG. 13 is a table showing the golf ball surface area coverage by dimples, dimple volume, and drag coefficients for the golf ball embodiments of FIGS. 11B-E.
FIG. 14 is a plot of the drag coefficient versus Reynolds number for golf ball embodiments of FIGS. 11B-E which are not spinning.

FIG. 14 illustrates the drag coefficient plotted against the Reynolds number for the plots 72, 73, 74, 75, and 76 for the golf ball embodiments 50, 51, 52, 53, and 54, respectively, when tested in the wind tunnel in a non-spinning setup. The prototype with the lowest drag coefficient in the supercritical regime is the golf ball 50 with a drag coefficient of $C_D$=0.166 at Re=185,000; this golf ball 50 has 92 spherical dimples 60. As the number of dimples 60 increases, the coefficient of drag increases, and is the highest for the golf ball 54 with 392 spherical dimples. The behavior exhibited by these embodiments is in agreement with the concept that dimples 60 incur a drag penalty, and that for a given dimple 60 shape, minimizing the number of dimples 60 on a sphere 14 reduces the drag coefficient. Another important factor is that the critical Reynolds number occurs the earliest and the latest for the golf balls 54 and 50, respectively, implying that more dimples 60 tend to accelerate the drag crisis.

Figure 15:
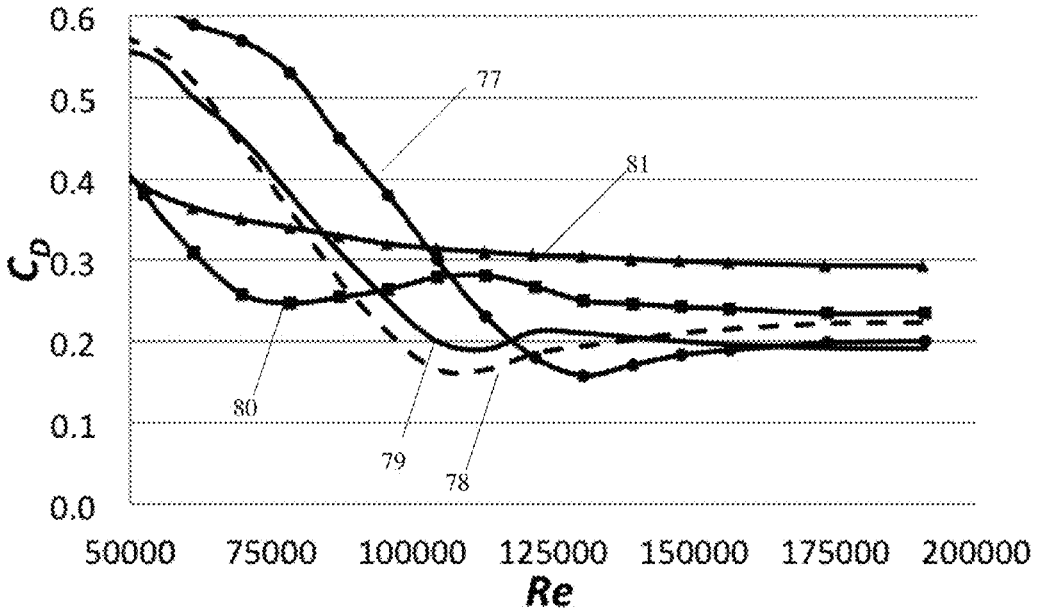
FIG. 15 is a plot of the drag coefficient versus Reynolds number for the golf ball embodiments of FIGS. 11B-E spinning at 2500 rpm.
Figure 16:
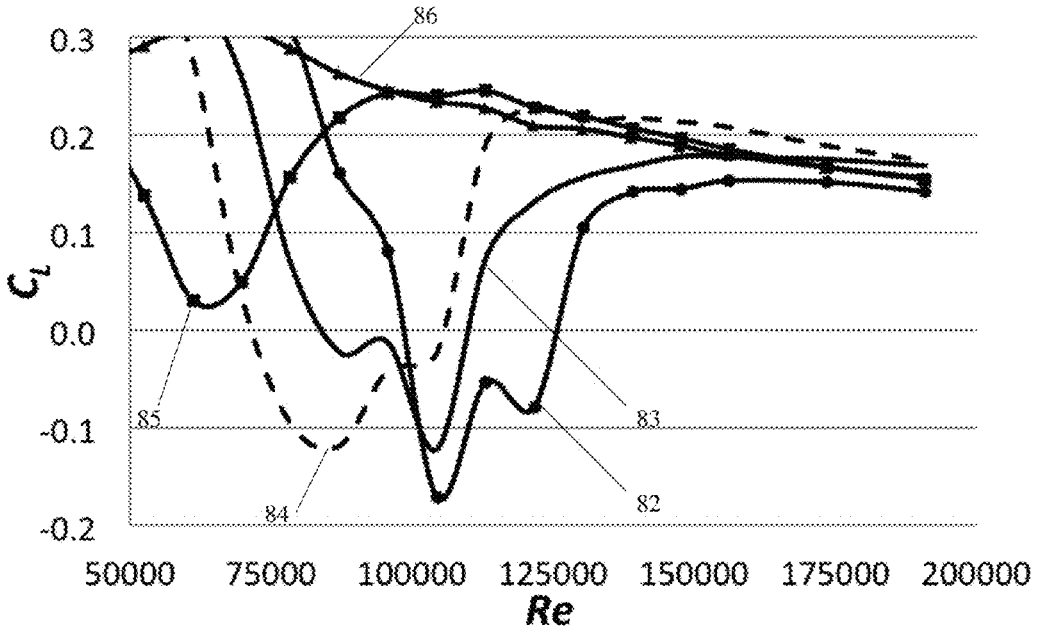
FIG. 16 is a plot of the coefficient of lift versus Reynolds number for the golf ball embodiments of FIGS. 11B-E spinning at 2500 rpm.

When the embodiments start spinning, lift is generated and the drag curves change as well. FIG. 15 illustrates the drag coefficient for the golf balls 50, 51, 52, 53, and 54 spinning at 2500 rpm. The plots of drag coefficient versus Reynolds numbers for the golf ball embodiments 50, 51, 52, 53, and 54 are respectively plots 77, 78, 79, 80, and 81. The spin has two main effects on drag. First, as the spin increases, the drag crisis becomes less steep and the critical Reynolds number occurs earlier. Second, in the supercritical regime, the drag increases. This phenomenon is commonly known as lift-induced drag and the amount of induced drag is related to the lift. In general however, the drag coefficient for the embodiments shows a similar trend as the corresponding one for the stationary cases. That is, the embodiments with the least dimple 60 coverage and volume percentage have the least drag in the supercritical regime. The lift coefficient curves for the embodiments spinning at 2500 rpm are shown in FIG. 16. The plots of lift coefficient versus Reynolds number for the golf ball embodiments 50, 51, 52, 53, and 54 are respectively plots 82, 83, 84, 85, and 86. The lift is generally positive in the supercritical regime and may become negative in a narrow region just before the critical Reynolds number. As the dimple 62 coverage and volume percentage decreases, the lift curves shift to the right and the lift coefficient in the supercritical regime is higher.

Figure 17A:
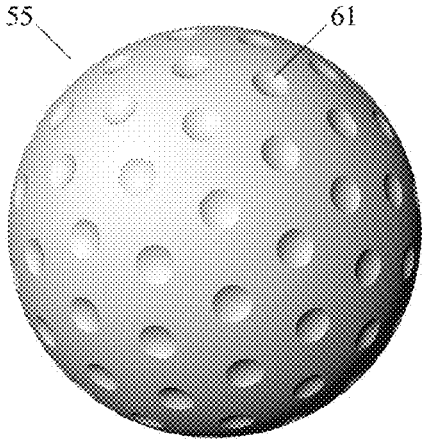
FIG. 17A is a diagram of a golf ball embodiment having 120 spherical dimples that are 25% deeper than the embodiments in FIGS. 11B-E.
Figure 17B:
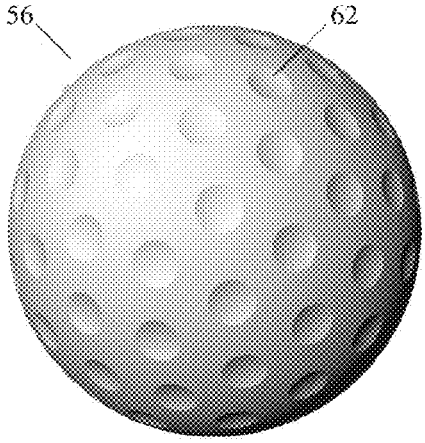
FIG. 17B is a diagram of golf ball embodiment having 120 spherical dimples that are 25% larger than the embodiments in FIGS. 11B-E.
Figure 17C:
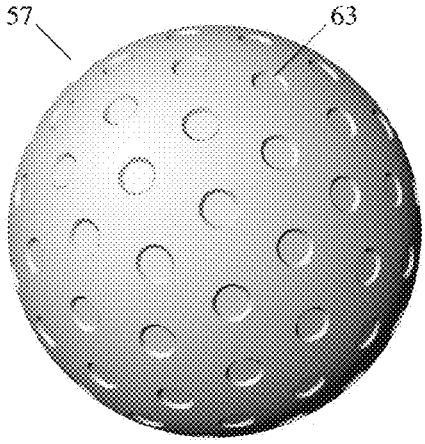
FIG. 17C is a diagram of a golf ball embodiment having 120 dimples shaped as truncated cones with walls.
Figure 18:
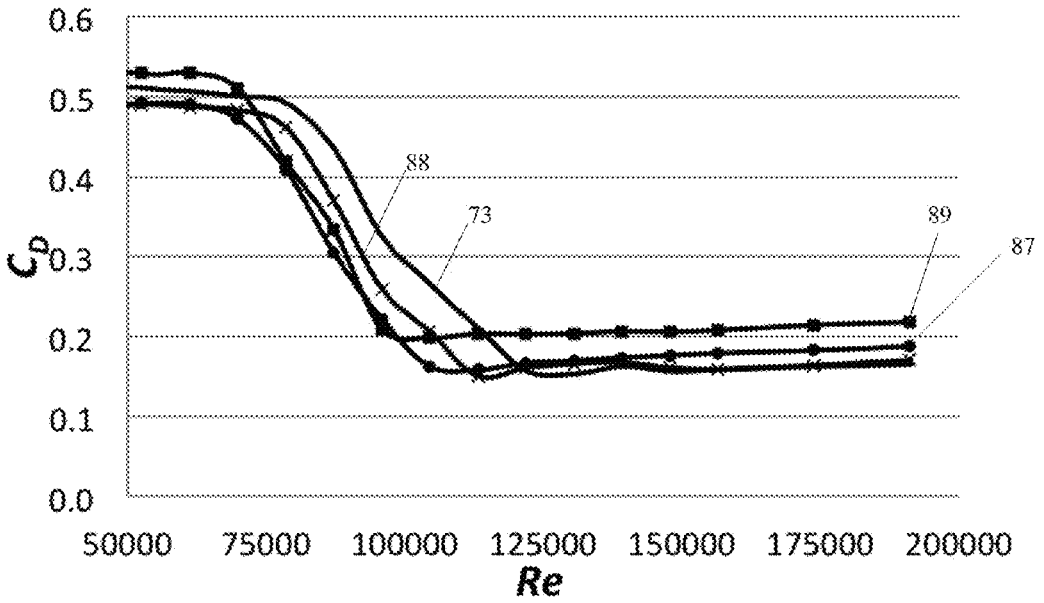
FIG. 18 is a plot of the drag coefficient versus Reynolds number for the non-spinning golf ball embodiments of FIGS. 17A, 17B, and 17C.
Figure 19:
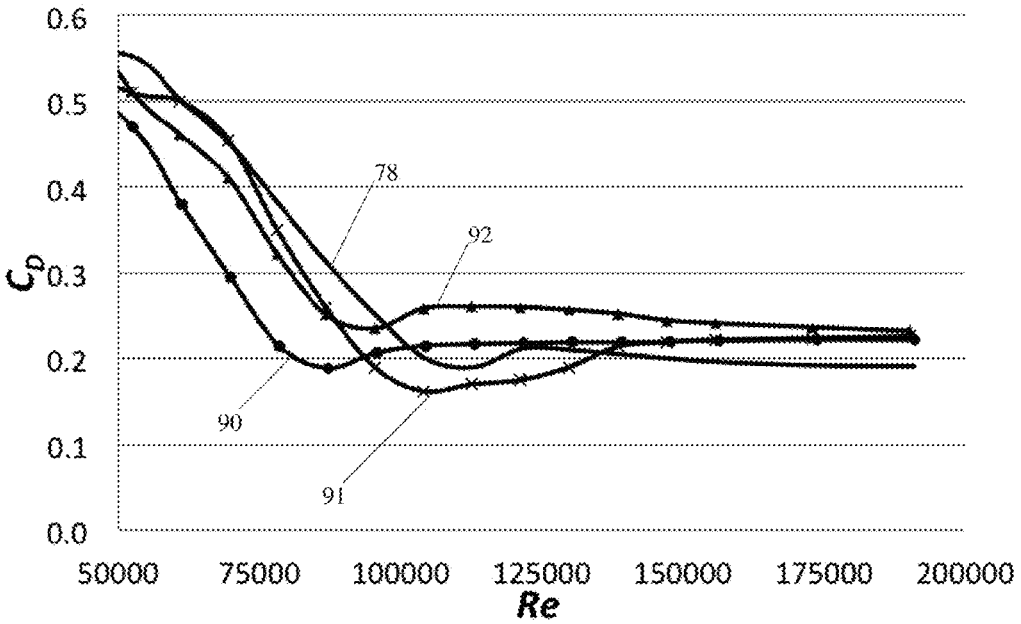
FIG. 19 is a plot of the coefficient of drag versus Reynolds number for the golf ball embodiments of FIGS. 17A, 17B, and 17C spinning at 2500 rpm.
Figure 20:
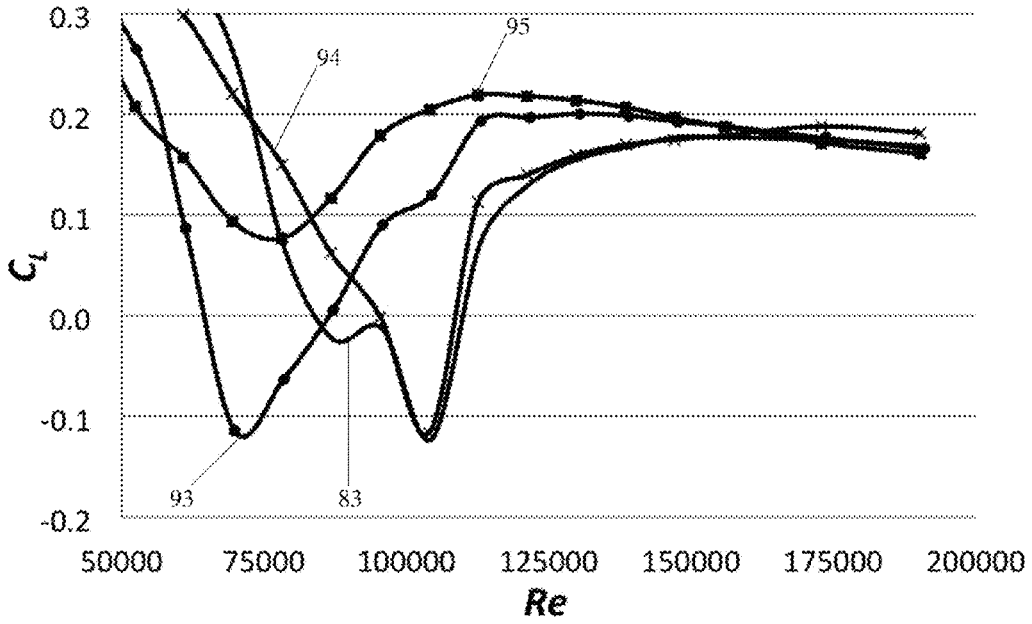
FIG. 20 is a plot of the coefficient of lift for the golf ball embodiments of 17A, 17B, and 17C spinning at 2500 rpm.

Finally, the effect of dimple 60 shape was also investigated. A seventh golf ball 55 embodiment, an eighth golf ball 56 embodiment, and a ninth golf ball 57 embodiment, with 120 dimples each and using the same dimple width or depth as the golf ball 51 embodiment were fabricated and tested in the wind tunnel. The golf balls 55, 56, and 57 are shown in FIGS. 17A, 17B, and 17C, respectively. The golf ball 55 has spherical dimples 61 with the same inscribed diameter, but the spherical dimples 61 are 25% deeper than the ones of the golf ball 51. The golf ball 56 has spherical dimples 62 with the same depth but 25% larger inscribed diameter compared to the golf ball 51. The golf ball 57 has dimples 63 with the same diameter and depth as the golf ball 51, but formed in the shape of a truncated cone, or conical frustum, with a 45-degree angle. The depth and outer inscribed diameter of the dimples 63 of golf ball 57 is the same as the ones of the golf ball 51. The dimple coverage for the golf balls 51, 55, and 57 are the same, namely 18%, while coverage for the golf ball 56 is higher at 27%. The dimple volume percentage is the lowest for the golf ball 51 at 0.49% and increases to 0.65%, 0.71%, and 0.77% for the golf ball 55, 56, and 57, respectively. The drag coefficient curves for the stationary case are shown in FIG. 18. The plots of the drag coefficient versus Reynolds number for the golf ball embodiments 51, 56, 56, and 57 are respectively shown as plots 73, 87, 88, and 89. Making the dimples deeper as in the golf ball 56 accelerates the drag crisis, but also increases the drag in the supercritical regime compared to the golf ball 51. A similar behavior is observed with the golf ball 57, although in this case, the effects are more pronounced. In contrast, making the dimple 60 diameter larger, as in the golf ball 56, while keeping the depth constant accelerates the drag crisis a little without adding any drag in the supercritical regime. A similar trend for the drag exists when the embodiments where tested in the spinning setup. As shown in FIGS. 19 and 20, the drag and lift coefficients are shown at 2500 rpm. In FIG. 19, the coefficient of drag versus Reynolds number for the golf ball embodiments 51, 55, 56, and 57 are shown as plots 78, 90, 91, and 92, respectively. In FIG. 20, the coefficient of lift versus Reynolds number for golf ball embodiments 51, 55, 56, and 57 are shown as plots 83, 93, 94, and 95 respectively. As shown in FIG. 20, the lift coefficient at the higher range of the supercritical regime is close amongst all the embodiments with the golf ball 56 having slightly higher lift than the others. The main difference occurs near the critical Reynolds number, where the lift decreases significantly and becomes negative for all but the golf ball 57.

Figure 21:
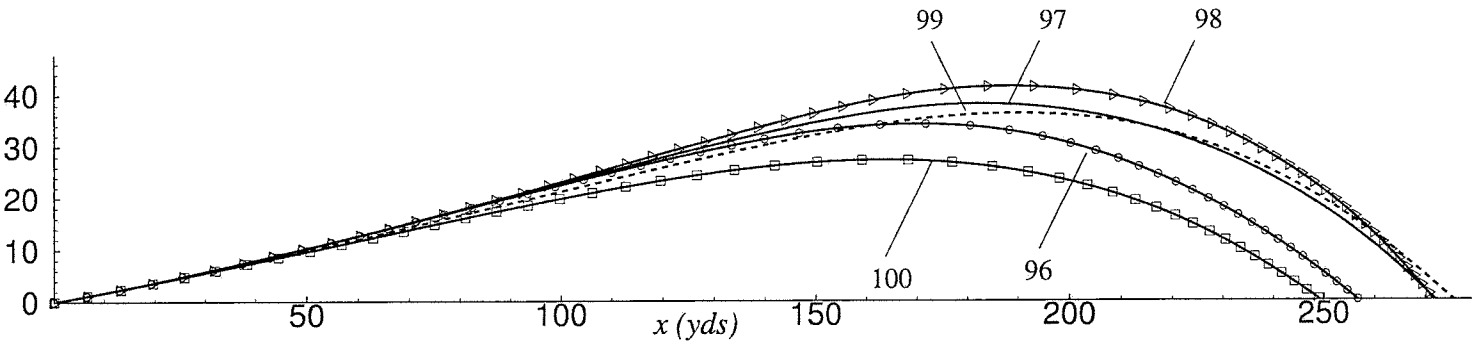
FIG. 21 is a plot of the trajectory for the golf ball embodiments of FIGS. 11B-E for a high swing speed representative of a PGA tour driver.

Using the drag and lift curves obtained from the wind tunnel tests, a trajectory analysis was performed. Two different swings were simulated: a high swing speed representative of PGA tour driver, shown in FIGS. 21 and 22, and a moderate swing representative of an amateur driver, shown in FIGS. 23 and 24. The launch conditions for the high swing correspond to a golf ball speed of 175 mph, a launch angle of 10°, and a spin of 2520 rpm. These launch conditions are also the ones used by USGA during the overall distance compliance tests. For the moderate swing the launch conditions correspond to a ball speed of 135 mph, a launch angle of 13°, and a spin of 3000 rpm. The trajectories account only for the carry distance, which is the distance covered from the tee to the first point of contact with the ground. The trajectories of the golf balls embodiments 50, 51, 52, 53, and 54 are shown as plots 96, 97, 98, 99, and 100, respectively, for the high swing speed, in FIG. 21. The golf ball 54, which has the largest dimple coverage and dimple volume percentage, traveled the shortest distance of golf balls embodiments 50, 51, 52, 53, and 54, due mainly to the golf ball's 54 relatively large drag coefficient in the supercritical regime. The golf ball 50 traveled the second shortest, due to the fact that the supercritical regime, where the drag coefficient is low, occurs at a relatively small portion of the trajectory in the beginning of the ball flight, and for the rest of the flight the drag coefficient increases considerably. Increasing the number of dimples 60 above golf ball 50, significantly adds to the carry distance and the golf balls 51, 52, and 53 all exceed 270 yards. The golf ball 53 reaches an estimated carry distance of 277 yards, which is about five yards further than the golf balls 51 and 52.

Figure 22:
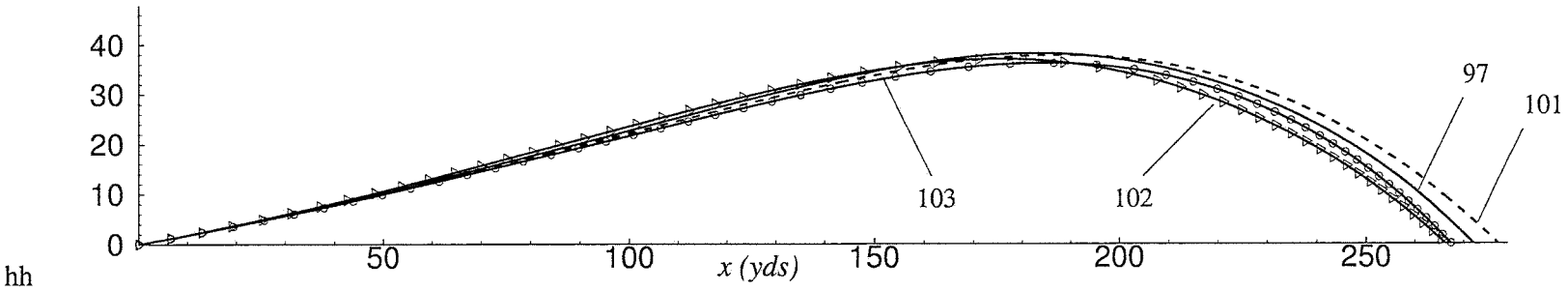
FIG. 22 is a plot of the trajectory for the golf ball embodiments of FIGS. 17A, 17B, and 17C for a high swing speed representative of a PGA tour driver.

The effect of dimple 60 shape on the trajectory of a high swing speed is shown in FIG. 22. The trajectory for the golf ball embodiments 51, 55, 56, and 57 are shown as plots 97, 101, 102, and 103, respectively. The variation in carry distance and maximum height is small and making the dimples deeper, as in the golf ball 55 embodiment, can help the golf ball 55 travel a few extra yards.

Figure 23:
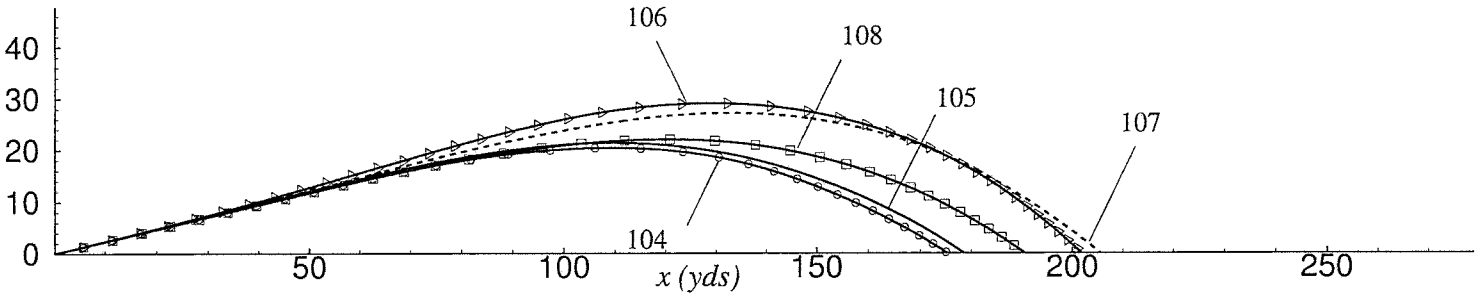
FIG. 23 is a plot of the trajectory for the golf ball embodiments of FIGS. 11B-E for a moderate swing speed representative of an amateur driver.
Figure 24:
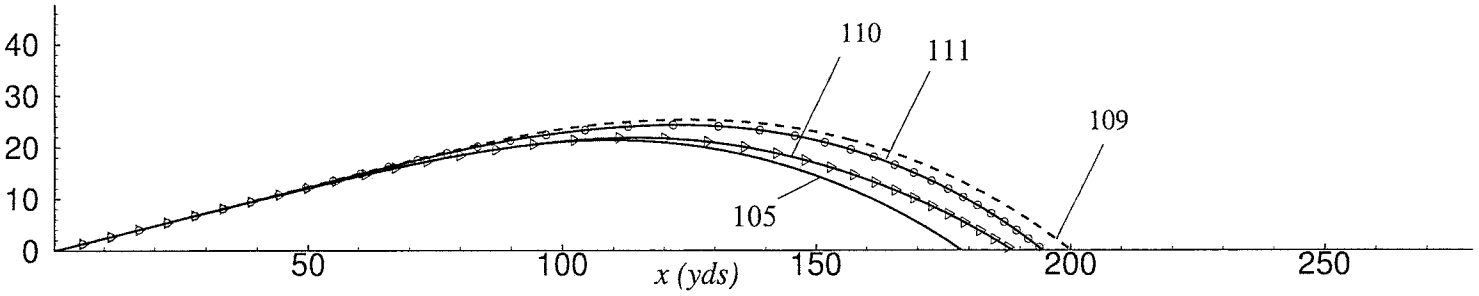
FIG. 24 is a plot of the trajectory for the golf ball embodiments of FIGS. 17A, 17B, and 17C for a moderate swing speed representative of an amateur driver.

FIG. 23 shows the trajectories for a moderate swing speed by an amateur player for the golf ball embodiments 50, 51, 52, 53, and 54 as plots 104, 105, 106, 107, and 108, respectively. The Reynolds number at launch conditions is 170,000, which is 22% lower than that of high swing speed. As a result, the embodiment golf balls 51 and 50, which experience a delayed drag crisis travel the shortest distance at just under 180 yards. The golf ball 54 travels farther at 191 yards while the golf balls 52 and 53 travel the farthest at 202 and 205 yards respectively. The number, coverage, and/or volume of dimples 60 seems to affect considerably the moderate swing speeds. FIG. 24 shows the trajectories for a moderate swing speed for the golf ball embodiments 51, 55, 56, and 57 as plots 105, 109, 110, and 111, respectively, under the launch conditions as in FIG. 23. The representative golf ball 51 travels the shortest distance of just under 180 yards, followed by the golf ball 56 having wider dimples 60 at about 190 yards, then the golf ball 57 having frustum-shaped dimples 60 at about 195 yards, and finally the golf ball 55 having deeper dimples 60 traveling the further distance of about 200 yards. The effect of dimple 60 shape seems to affect considerably the moderate swing speeds.

Figure 25A:
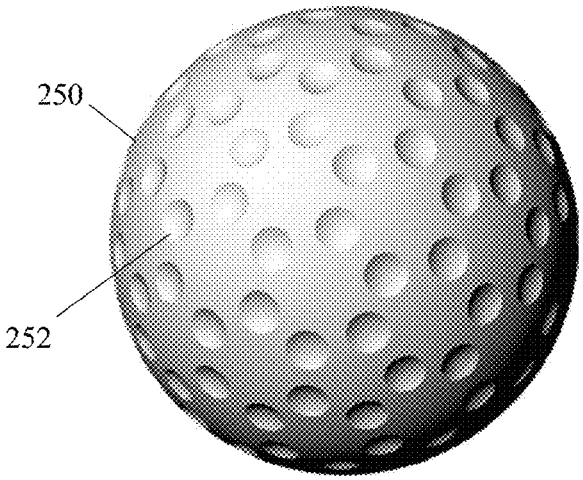
FIG. 25A is a diagram of a golf ball embodiment having 180 spherical dimples that are 25% deeper than those in the embodiments in FIGS. 11B-E.
Figure 25B:
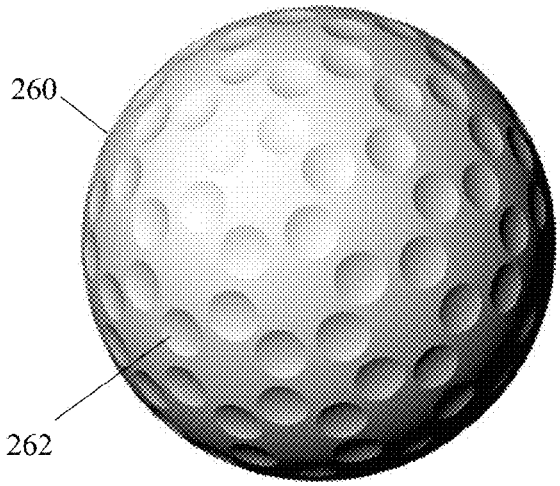
FIG. 25B is a diagram of a golf ball embodiment having 180 spherical dimples that are 25% larger than the embodiment in FIG. 25A that are 25% wider than those in the embodiments in FIGS. 11B-E.
Figure 25C:
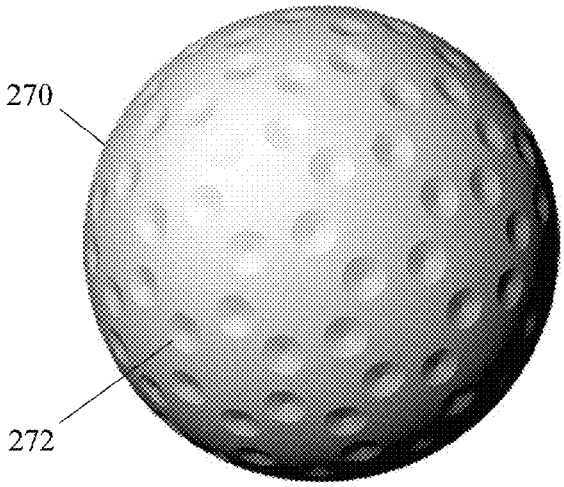
FIG. 25C is a diagram of a golf ball embodiment having 180 dimples shaped as cones with walls.

FIGS. 25A-C illustrate additional embodiments of the present low dimple coverage golf balls with diameter D, in accordance with the above descriptions of ball and dimple characteristics. Golf ball 250 of FIG. 25A, golf ball 260 of FIG. 25B, and golf ball 270 of FIG. 25C each have 180 dimples arranged according to an icosahedral structure as described above. In FIG. 25A, the golf ball 250 includes symmetrically arranged and uniformly configured spherical dimples 252 having a dimple diameter of 0.079D and a dimple depth of 0.011D. In FIG. 25B, the golf ball 260 includes symmetrically arranged and uniformly configured spherical dimples 262 with a dimple diameter of 0.098D, about 25% larger than the dimples 252 of FIG. 25A, and a dimple depth of 0.0087D. In FIG. 25C, the golf ball 270 includes symmetrically arranged and uniformly configured conical dimples 272 with a dimple diameter of 0.078D and a dimple depth of 0.011D.

Figure 26A:
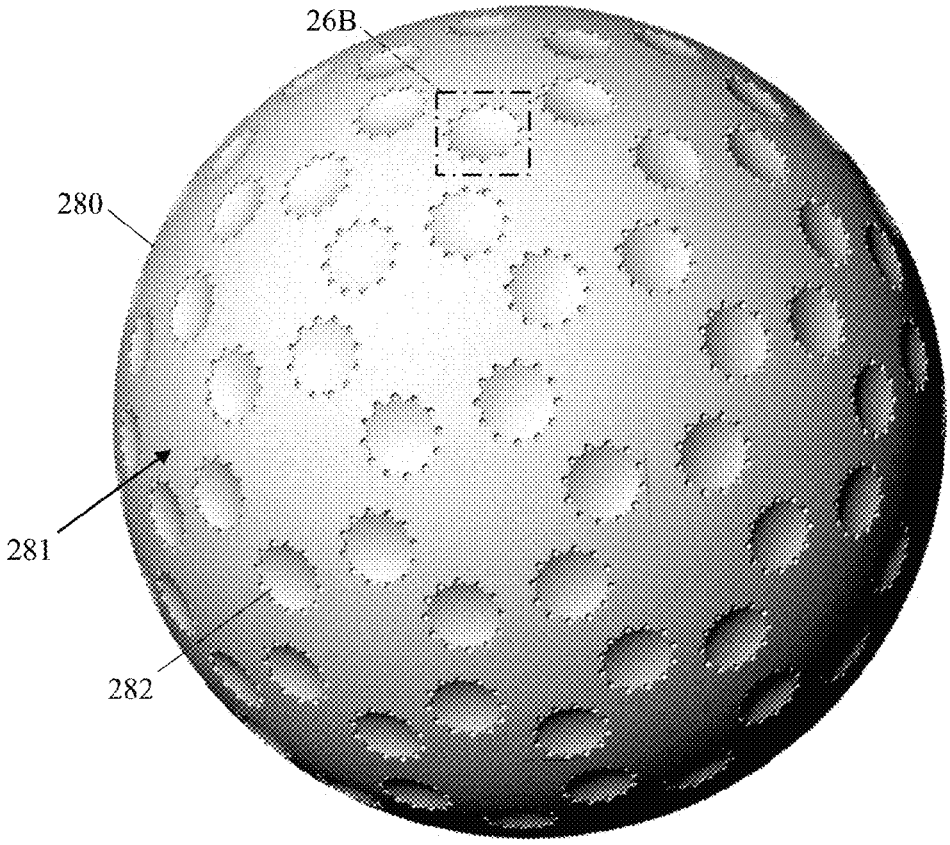
FIG. 26A is a diagram of a golf ball embodiment having 180 spherical dimples with protrusions and recesses formed into the dimple rim.
Figure 26B:
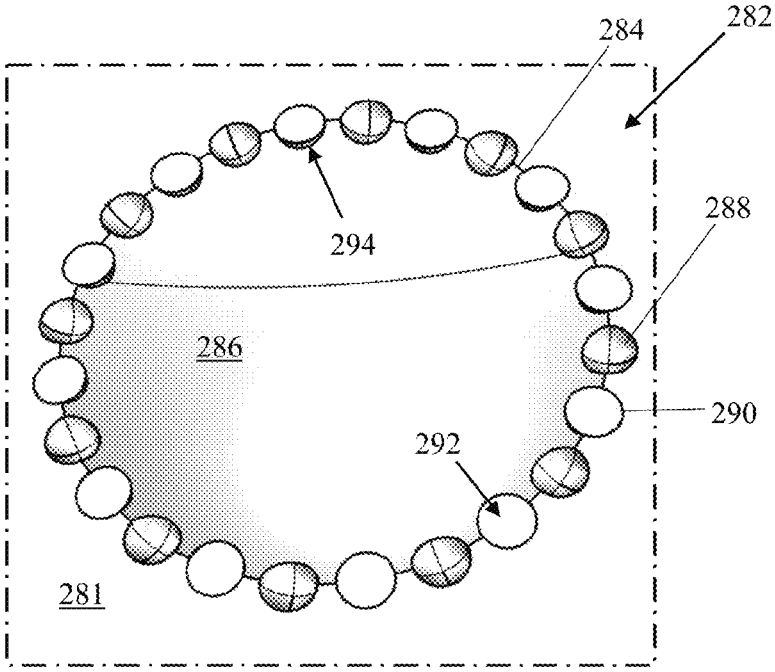
FIG. 26B is a close-up view of a dimple of the golf ball of FIG. 26A, according to inset 26B of FIG. 26A.
Figure 27A:
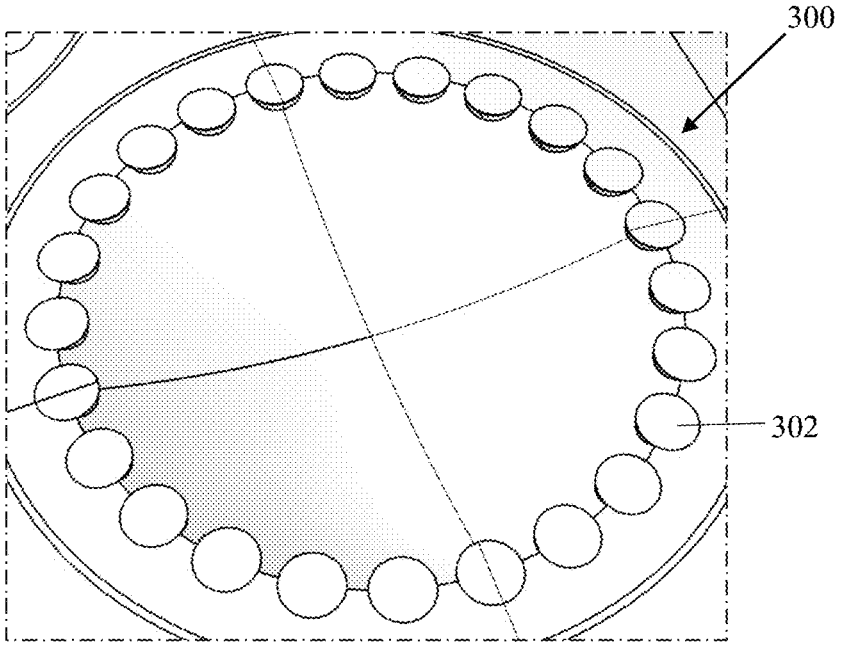
FIG. 27A is a diagram of an alternative embodiment of a dimple with protrusions formed into the dimple rim.
Figure 27B:
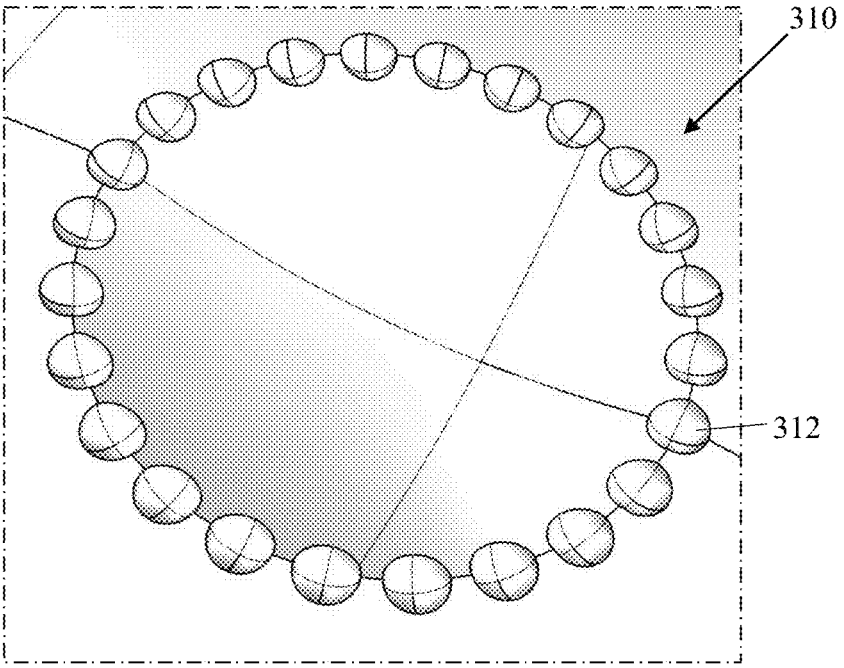
FIG. 27B is a diagram of an alternative embodiment of a dimple with recesses formed into the dimple rim.

In the presently disclosed golf balls, the dimples may further have one or more structures recessed into or protruding from either or both of the surface and the rim of the dimple. Referring to FIGS. 26A-B, another exemplary embodiment of a low dimple coverage golf ball 280 with diameter D has dimples 282 (e.g., 180, as illustrated), which are symmetrically arranged and have a uniform spherical profile, as described above. For example, the dimple diameter may be 0.078D and the dimple depth may be 0.087D. Additionally, each dimple 282 has an arrangement of recesses 288 and/or protrusions 290 formed into the rim 284 of the dimple 282, where the concave dimple surface 286 meets the outer surface 281 of the golf ball 280. In some embodiments, as illustrated, the recesses 288 and protrusions 290 may be alternated around the entire circumference defined by the rim 284; in other embodiments, only a portion of the rim 284 may include the recesses 288 and/or protrusions 290, which may be arranged in repeating or other patterns besides alternating. For example, FIG. 27A illustrates an alternative dimple 300 having only protrusions 302 and no recesses, and FIG. 27B illustrates an alternative dimple 310 having only recesses 312 and no protrusions. The recesses 288 and/or protrusions 290 may be uniform in size, as illustrated, or may be any arrangement of different sizes. Thus, the size, shape, number, and spacing of the recesses 288 and protrusions 290 may be selected to optimize the performance of the golf ball 280. This arrangement creates a more three dimensional effect around the dimple rim 284, which can trigger transition to a turbulent flow at a lower Reynolds number.

Referring again to the illustrated arrangement of FIG. 26B, a recess 288 may be any suitable volumetric shape formed into one or both of the outer surface 281 and the dimple surface 286 (e.g., in both when formed into the rim 284). For example, subtracting an intersecting volume between the golf ball 280 and a sphere (not shown), as described above, creates a spherical recess 288. The diameter of the sphere used in the subtraction may be related to the diameter of the golf ball 280 and/or to the diameter of the dimple 282, and may further depend on the number and/or spacing of structures around the rim 284. In one embodiment, the diameter of the subtracting sphere is about 10% of the diameter of the sphere used to make the dimple 282 itself.

Similarly, a protrusion 290 may be any suitable volumetric shape formed into one or both of the outer surface 281 and the dimple surface 286 (e.g., in both when formed into the rim 284). For example, to create a "spherical" protrusion 290 as in the illustrated embodiment, a sphere (not shown) with a diameter of about 10% of the diameter of the dimple 282 may be intersected with the outer surface 281 of the golf ball 280, and with the dimple surface 286. The portion of the sphere outside of the outer surface 281 may be subtracted, leaving the outer surface 292 of the protrusion 290 flush with the outer surface 281. The spherical inner surface 294 of the protrusion 290 may project toward the center of the dimple 282.

Another test of golf balls in accordance with the present disclosure included performance comparisons of the golf balls 250, 260, 270, 280 of FIGS. 25A-26B against a popular USGA golf ball; the results of this test are reflected in Table 1, below. In particular, prototypes of the four embodiments were tested against the present market-leading golf ball, the PRO V1 by TITLEIST, each being hit multiple times by the same professional golfer under reasonably reproducible conditions. Launch conditions correspond to the lower range of a professional golfer's swing. One embodiment, the golf ball 250, is shown to be hittable with a carry distance that is within about two yards, or under 1%, of the current leading golf ball.

TABLE 1

Outdoor Testing of Embodiments

| | Launch Conditions | | | | Performance | |
|---|---|---|---|---|---|---|
| Golf Ball | Ball speed | Launch Angl. | Spin rate | Spin axis | Carry dist. | Total dist. |
| Pro V1 | 145.2 | 7.0 | 4222 | 9.1 | 216.9 | 234.9 |
| | 148.9 | 6.7 | 3762 | 1.0 | 227.8 | 248.2 |
| | 149.8 | 9.1 | 4268 | 9.3 | 229.2 | 243.6 |
| | 141.7 | 4.7 | 3734 | 4.1 | 203.8 | 230.4 |
| | 147.9 | 11.4 | 2209 | 2.6 | 239.2 | 269.8 |
| Ball 250 | 149.3 | 9.3 | 2694 | 2.2 | 237.6 | 264.9 |
| | 138.5 | 7.3 | 3965 | 3.3 | 205.6 | 226.2 |
| | 139.6 | 8.6 | 2935 | −11.6 | 210.1 | 238.6 |
| Ball 260 | 144.6 | 9.2 | 3549 | 4.8 | 225.5 | 245.1 |
| | 139.2 | 8.4 | 4252 | 8.4 | 207.1 | 224.6 |
| Ball 270 | 147.9 | 9.1 | 2985 | 7.0 | 233.5 | 258.1 |
| | 139.6 | 8.6 | 2935 | −11.6 | 210.1 | 238.6 |
| Ball 280 | 144.8 | 6.4 | 4052 | 6.7 | 216.2 | 236.0 |
| | 148.6 | 6.9 | 2652 | −5.3 | 222.9 | 256.4 |
| | 150.4 | 7.5 | 3326 | −0.2 | 234.7 | 257.6 |

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations.

It will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular embodiments disclosed, but that such claimed subject matter may also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter may be practiced without these specific details. In other instances, methods, apparatuses, or systems that would be known by one of ordinary skill have not been described in detail so as not to obscure claimed subject matter.

Reference throughout this specification to "one embodiment" or "an embodiment" may mean that a particular feature, structure, or characteristic described in connection with a particular embodiment may be included in at least one embodiment of claimed subject matter. Thus, appearances of the phrase "in one embodiment" or "an embodiment" in various places throughout this specification is not necessarily intended to refer to the same embodiment or to any one particular embodiment described. Furthermore, it is to be understood that particular features, structures, or characteristics described may be combined in various ways in one or more embodiments. In general, of course, these and other issues may vary with the particular context of usage. Therefore, the particular context of the description or the usage of these terms may provide helpful guidance regarding inferences to be drawn for that context.

What is claimed is:

1. A golf ball, comprising:

a spherical outer surface having a ball diameter that is the golf ball's maximum diameter; and a plurality of dimples formed into the outer surface and arranged into a substantially symmetrical pattern entirety around the outer surface, each of the plurality of dimples having a corresponding dimple depth and a corresponding dimple diameter, less than 70% of the outer surface being covered by the plurality of dimples, wherein the plurality of dimples express icosadeltahedral symmetry.

2. The golf ball of claim 1, wherein the dimple depth is less than or equal to about 0.01 times the ball diameter.

3. The golf ball of claim 1, wherein the dimple diameter is less than one-tenth of the ball diameter.

4. The golf ball of claim 1, wherein the plurality of dimples are each formed as a conical frustum.

5. The golf ball of claim 1, wherein the plurality of dimples each have a spherical geometry.

6. The golf ball of claim 1, wherein the plurality of dimples cover less than 44% of the outer surface.

7. The golf ball of claim 6, wherein the plurality of dimples cover more than 18% of the outer surface.

8. The golf ball of claim 1, wherein the plurality of dimples number between 110 and 272, inclusive.

9. The golf ball of claim 1, wherein the plurality of dimples consists of a first number of the dimples, and wherein a solution to the Thomson problem for placing the first number of electrons on a sphere is used to position the first number of dimples on the outer surface, each dimple of the first number of dimples having a corresponding electron of the first number of electrons.

10. A golf ball, comprising:

a spherical outer surface having a first diameter; and a plurality of dimples formed into the outer surface and arranged around the outer surface, between 18% and 61% of the outer surface being covered by the plurality of dimples, wherein the plurality of dimples express icosadeltahedral symmetry around the outer surface.

11. The golf ball of claim 10, wherein the plurality of dimples are spherical and have a uniform second diameter less than one-tenth of the first diameter.

12. The golf ball of claim 11, wherein the plurality of dimples number between 110 and 272, inclusive, and have a uniform depth of at least 0.0087 times the first diameter.

13. The golf ball of claim 10, wherein an aggregate dimple volume, measured as the sum of a dimple volume of each dimple of the plurality of dimples, is between 0.38% and 1.61%, inclusive, of a volume of a smooth sphere having the first diameter.

14. The golf ball of claim 13, wherein the plurality of dimples have a uniform depth greater than 0.0065 times the first diameter.

15. The golf ball of claim 10, wherein a first dimple of the plurality of dimples comprises:

a dimple surface that intersects the outer surface of the golf ball; and a rim formed at the intersection of the dimple surface with the outer surface, the rim comprising either or both of:

one or more recesses formed into the rim; and one or more protrusions extending away from the rim.

* * * * *